US008814654B2

(12) United States Patent
Hoffman et al.

(10) Patent No.: US 8,814,654 B2
(45) Date of Patent: Aug. 26, 2014

(54) GAMING SYSTEM, GAMING DEVICE AND METHOD PROVIDING TRACE SYMBOLS

(75) Inventors: Benjamin C. Hoffman, Reno, NV (US); Paulina Rodgers, Reno, NV (US); Christmas C. Parker, Reno, NV (US)

(73) Assignee: IGT, Las Vegas, NV (US)

( * ) Notice: Subject to any disclaimer, the term of this patent is extended or adjusted under 35 U.S.C. 154(b) by 1685 days.

(21) Appl. No.: 12/271,018

(22) Filed: Nov. 14, 2008

(65) Prior Publication Data

US 2010/0124968 A1 May 20, 2010

(51) Int. Cl.
*A63F 9/24* (2006.01)
*G07F 17/32* (2006.01)

(52) U.S. Cl.
CPC ..... *G07F 17/3202* (2013.01); *G07F 17/3211* (2013.01); *G07F 17/3265* (2013.01)
USPC ..... 463/20; 463/25; 463/40; 463/42

(58) Field of Classification Search
USPC ..... 463/20, 25, 40, 42
See application file for complete search history.

(56) References Cited

U.S. PATENT DOCUMENTS

| | | | | |
|---|---|---|---|---|
| 4,695,053 | A | 9/1987 | Vazquez, Jr. et al. | |
| 5,395,111 | A | 3/1995 | Inoue | |
| 5,766,074 | A | 6/1998 | Cannon et al. | |
| 5,833,537 | A | 11/1998 | Barrie | |
| 5,935,002 | A | 8/1999 | Falciglia | |
| 5,980,384 | A | 11/1999 | Barrie | |
| 5,984,781 | A | 11/1999 | Sunaga | |
| 6,012,982 | A | 1/2000 | Piechowiak et al. | |
| 6,015,346 | A | 1/2000 | Bennett | |
| 6,027,115 | A | 2/2000 | Griswold et al. | |
| 6,053,813 | A | 4/2000 | Mathis | |
| 6,056,642 | A | 5/2000 | Bennett | |
| 6,059,289 | A | 5/2000 | Vancura | |
| 6,086,066 | A | 7/2000 | Takeuchi et al. | |
| 6,089,976 | A | 7/2000 | Schneider et al. | |
| 6,095,921 | A | 8/2000 | Walker et al. | |
| 6,102,798 | A | 8/2000 | Bennett | |
| 6,120,378 | A * | 9/2000 | Moody et al. | 463/20 |

(Continued)

FOREIGN PATENT DOCUMENTS

| | | |
|---|---|---|
| WO | WO99/44095 | 9/1999 |
| WO | WO01/09664 | 2/2001 |
| WO | WO01/15127 | 3/2001 |
| WO | WO01/15128 | 3/2001 |
| WO | WO01/15132 | 3/2001 |
| WO | WO2006/038819 | 4/2006 |

OTHER PUBLICATIONS

Jackpot Hunter Mystery Progressives Advertisement, written by IGT, published in 2005.
Jackpot Hunter Mystery Progressives Article [online] [retrieved on Jan. 21, 2008, available prior to Sep. 28, 2007]. Retrieved from the Internet at <URL: http://www.igt.com>.

(Continued)

*Primary Examiner* — Paul A D'Agostino
*Assistant Examiner* — Brandon Gray
(74) *Attorney, Agent, or Firm* — Neal, Gerber & Eisenberg LLP

(57) ABSTRACT

The gaming device includes a plurality of mechanical reels which have a plurality of symbols including a plurality of trace symbols. The gaming device includes at least one light source configured to illuminate portions of the mechanical reels when the mechanical reels generate the trace symbols so that for at least one subsequent spin of the mechanical reels, the gaming device can indicate that the mechanical reels generated the trace symbols during a previous spin of the mechanical reels.

22 Claims, 26 Drawing Sheets

(56) References Cited

U.S. PATENT DOCUMENTS 6,126,165 A 10/2000 Sakamoto
6,142,875 A 11/2000 Kodachi et al.
6,155,925 A 12/2000 Giobbi et al.
6,159,097 A 12/2000 Gura
6,159,098 A 12/2000 Slomiany et al.
6,165,070 A 12/2000 Nolte et al.
6,168,522 B1 1/2001 Walker et al.
6,168,523 B1 1/2001 Piechowiak et al.
6,174,233 B1 1/2001 Sunaga et al.
6,174,235 B1 1/2001 Walker et al.
6,186,894 B1 2/2001 Mayeroff
6,206,781 B1 3/2001 Sunaga et al.
6,224,483 B1 5/2001 Mayeroff
6,227,971 B1 * 5/2001 Weiss ..... 463/20
6,231,442 B1 5/2001 Mayeroff
6,231,445 B1 5/2001 Acres
6,254,481 B1 7/2001 Jaffe
6,270,411 B1 8/2001 Gura et al.
6,270,412 B1 8/2001 Crawford et al.
6,311,974 B1 11/2001 Koga
6,311,976 B1 11/2001 Yoseloff et al.
6,315,289 B1 11/2001 Sakamoto et al.
6,319,124 B1 11/2001 Baerlocher et al.
6,517,433 B2 2/2003 Loose et al.
6,558,254 B2 5/2003 Baelocher et al.
6,602,137 B2 8/2003 Kaminkow et al.
6,607,428 B2 8/2003 Tolles
6,632,139 B1 10/2003 Baerlocher
6,634,943 B1 10/2003 Baerlocher
6,663,489 B2 12/2003 Baerlocher
6,692,356 B2 2/2004 Baerlocher et al.
6,726,563 B1 4/2004 Baerlocher et al.
6,796,899 B2 9/2004 Baerlocher
6,796,900 B2 9/2004 Baerlocher et al.
6,817,944 B2 11/2004 Kaminkow et al.
6,875,108 B1 4/2005 Hughs-Baird
6,929,952 B2 8/2005 Baerlocher
6,937,298 B2 8/2005 Okada
6,955,600 B2 10/2005 Glavich et al.
6,958,013 B2 10/2005 Miereau et al.
6,976,915 B2 12/2005 Baker et al.
7,004,835 B2 2/2006 Baerlocher
7,033,270 B2 4/2006 Baerlocher et al.
7,048,631 B2 5/2006 Goins et al.
7,056,214 B2 6/2006 Miereau et al.
7,074,127 B2 7/2006 Cuddy et al.
7,094,148 B2 8/2006 Baerlocher et al.
7,104,888 B2 9/2006 Miereau et al.
7,112,136 B2 9/2006 Anderson et al.
7,140,963 B2 11/2006 Kojima
7,214,132 B2 5/2007 Inoue
7,220,181 B2 5/2007 Okada
7,235,011 B2 6/2007 Randall et al.
7,238,110 B2 7/2007 Glavich et al.
7,255,643 B2 8/2007 Ozaki et al.
7,314,409 B2 1/2008 Maya et al.
7,326,109 B2 2/2008 Baerlocher
7,338,367 B2 3/2008 Kaminkow et al.
7,338,369 B2 3/2008 Mierau et al.
7,452,276 B2 11/2008 Loose et al.
7,479,065 B1 * 1/2009 McAllister et al. ..... 463/37
2002/0052233 A1 5/2002 Gauselmann
2003/0013517 A1 1/2003 Bennett et al.
2003/0073484 A1 4/2003 Jo
2003/0087690 A1 5/2003 Loose et al.
2003/0092480 A1 * 5/2003 White et al. ..... 463/20
2003/0216165 A1 11/2003 Singer et al.
2004/0021705 A1 2/2004 Baker et al.
2004/0033828 A1 2/2004 Gagner
2004/0038726 A1 2/2004 Inoue
2004/0067790 A1 4/2004 Peterson et al.
2004/0067791 A1 * 4/2004 Glavich et al. ..... 463/20
2004/0127280 A1 * 7/2004 Moody ..... 463/20
2005/0014548 A1 1/2005 Thomas
2005/0020349 A1 1/2005 Tachikawa
2005/0033461 A1 2/2005 Gerrard et al.
2005/0043082 A1 2/2005 Peterson et al.
2005/0054434 A1 3/2005 Baerlocher et al.
2005/0059455 A1 3/2005 Gerrard et al.
2005/0059486 A1 3/2005 Kaminkow
2005/0075163 A1 4/2005 Cuddy et al.
2005/0101372 A1 5/2005 Mierau et al.
2005/0159200 A1 7/2005 Nicely et al.
2005/0181879 A1 8/2005 Rothschild
2005/0192084 A1 9/2005 Iwamoto
2006/0009286 A1 1/2006 Durham et al.
2006/0030387 A1 2/2006 Jackson
2006/0030392 A1 * 2/2006 Rodgers et al. ..... 463/16
2006/0040723 A1 2/2006 Baerlocher et al.
2006/0040732 A1 2/2006 Baerlocher et al.
2006/0040733 A1 2/2006 Baerlocher et al.
2006/0040734 A1 2/2006 Baerlocher et al.
2006/0040736 A1 2/2006 Baerlocher et al.
2006/0073871 A1 4/2006 Rodgers et al.
2006/0073877 A1 4/2006 Rodgers et al.
2006/0100014 A1 5/2006 Griswold et al.
2006/0121972 A1 6/2006 Walker et al.
2006/0128467 A1 6/2006 Thomas
2006/0148549 A1 7/2006 Walker et al.
2007/0010316 A1 1/2007 Baerlocher et al.
2007/0010318 A1 1/2007 Rigsby et al.
2007/0037624 A1 2/2007 Mitchell et al.
2007/0054732 A1 3/2007 Baerlocher
2007/0054733 A1 3/2007 Baerlocher
2007/0060248 A1 3/2007 Rodgers et al.
2007/0060294 A1 3/2007 Cuddy et al.
2007/0060316 A1 3/2007 O'Halloran
2007/0077986 A1 4/2007 Loose et al.
2007/0087812 A1 * 4/2007 Glavich et al. ..... 463/16
2007/0105619 A1 5/2007 Kniesteadt et al.
2007/0105620 A1 5/2007 Cuddy et al.
2007/0129128 A1 6/2007 McClintic
2007/0155485 A1 7/2007 Cuddy et al.
2007/0218975 A1 9/2007 Iddings et al.
2007/0218982 A1 9/2007 Baerlocher
2007/0228651 A1 10/2007 Loose et al.
2007/0259709 A1 11/2007 Kelly et al.
2008/0004104 A1 1/2008 Durham et al.
2008/0020823 A1 1/2008 Cuddy et al.
2008/0020824 A1 1/2008 Cuddy et al.
2008/0020839 A1 1/2008 Wells et al.
2008/0064481 A1 3/2008 Jackson et al.
2008/0064497 A1 3/2008 Griswold et al.
2008/0076514 A1 3/2008 Baerlocher et al.
2008/0090651 A1 4/2008 Baerlocher
2008/0102920 A1 5/2008 Baerlocher
2008/0108422 A1 5/2008 Hedrick et al.
2008/0113736 A1 5/2008 Shackelford et al.
2008/0113749 A1 5/2008 Williams et al.
2008/0113755 A1 5/2008 Rasmussen et al.
2008/0113760 A1 5/2008 Baerlocher
2008/0113779 A1 5/2008 Cregan
2008/0139274 A1 6/2008 Baerlocher
2008/0153564 A1 6/2008 Baerlocher et al.
2008/0200237 A1 8/2008 Cuddy et al.
2008/0207303 A1 8/2008 Rasmussen
2008/0227520 A1 * 9/2008 Kato et al. ..... 463/20
2008/0274788 A1 11/2008 Wilson
2009/0017903 A1 1/2009 Mizoguchi et al.
2009/0149242 A1 6/2009 Woodard et al.
2010/0029364 A1 2/2010 Zielinski
2010/0120495 A1 5/2010 Frank et al.
2010/0120499 A1 5/2010 Cohen
2011/0117987 A1 * 5/2011 Aoki et al. ..... 463/20

OTHER PUBLICATIONS

Hot Hot Penny Series Game Description [online] [retrieved on Jan. 21, 2008, available prior to Sep. 28, 2007.] Retrieved from the Internet at <URL: http://www.videoslotmachines.com>.

* cited by examiner

GAMING SYSTEM, GAMING DEVICE AND METHOD PROVIDING TRACE SYMBOLS

COPYRIGHT NOTICE

A portion of the disclosure of this patent document contains material which is subject to copyright protection. The copyright owner has no objection to the photocopy reproduction of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and on the amount of the wager (e.g., the higher the wager, the higher the award). Symbols or symbol combinations which are less likely to occur usually provide higher awards.

In certain known gaming machines, the amount of the wager made on the base game by the player may vary. For instance, the gaming machine may enable the player to wager a minimum number of credits, such as one credit (e.g., one cent, nickel, dime, quarter or dollar) up to a maximum number of credits, such as five credits. This wager may be made by the player a single time or multiple times in a single play of the primary game. For instance, a slot game may have one or more paylines and the slot game may enable the player to make a wager on each payline in a single play of the primary game. Thus, it is known that a gaming machine, such as a slot game, may enable players to make wagers of substantially different amounts on each play of the primary or base game.

Secondary or bonus games are also known in gaming machines. The secondary or bonus games usually provide an additional award to the player. Secondary or bonus games usually do not require an additional wager by the player to be activated. Secondary or bonus games are generally activated or triggered upon an occurrence of a designated triggering symbol or triggering symbol combination in the primary or base game. For instance, a bonus symbol occurring on the payline on the third reel of a three reel slot machine may trigger the secondary bonus game. When a secondary or bonus game is triggered, the gaming machines generally indicates this to the player through one or more visual and/or audio output devices, such as the reels, lights, speakers, video screens, etc. Part of the enjoyment and excitement of playing certain gaming machines is the occurrence or triggering of the secondary or bonus game (even before the player knows how much the bonus award will be).

Known video slot games use symbols which have an effect on additional spins in the video slot game. These symbols typically build anticipation and excitement in video slot games. However, in physical reel slot games, visual presentation of displayed symbols having effects on additional spins of the reels has been limited because the spinning motion of the reels prevents displaying a symbol that does not move during the spin of the reels. To increase player enjoyment and excitement, it is desirable to provide players with new types of gaming devices that attract the player and keep the player entertained. Accordingly, a need exists for the further development of gaming devices.

SUMMARY

One embodiment of the present disclosure includes a gaming device having a cabinet supporting a plurality of mechanical reels which have a plurality of symbols including a plurality of trace symbols. The gaming device includes at least one light source supported by the cabinet configured to illuminate portions of the mechanical reels when the mechanical reels generate the trace symbols so that for one or more subsequent spins of the mechanical reels, the gaming device can indicate to the player that the mechanical reels generated the trace symbols during a previous spin of the mechanical reels. Each mechanical reel which displayed one of the trace symbols can generate and display symbols for one or more subsequent spins because the light source indicates to the player the portion of the reel that displayed the trace symbol. In various embodiments, for one or more of the spins, the gaming device evaluates multiple indicated trace symbols alone or in combination with other symbols displayed on the mechanical reels to determine awards to provide to the player.

The gaming device can employ the trace symbols and the light source in a primary game and/or in a secondary game. In one example embodiment where the gaming device employs the trace symbols and the light source in a primary game, the gaming device employs the trace symbols and the light source in a plurality of sequential wagering games played by the player. In another example embodiment where the gaming device employs the trace symbols and the light source in a secondary game, the gaming device employs the trace symbols and the light source in a plurality of sequentially provided free spins of the mechanical reels. In this example embodiment, the gaming device provides the secondary game upon an occurrence of a designated triggering event.

In one embodiment, the trace symbols function as wild symbols and when a mechanical reel displays one of the trace symbols, the light source indicates a wild symbol position to the player by illuminating the portion of the mechanical reel that displays the trace symbol for one or more subsequent spins of the mechanical reel. The mechanical reel which displayed the trace symbol can generate and display symbols for one or more subsequent spins because the light source indicates to the player that the mechanical reel previously displayed the trace symbol in the illuminated position.

In another embodiment, the gaming device accumulates the trace symbols and provides an award based on a designated quantity of accumulated trace symbols displayed by the mechanical reels in one or more spins. The light source illuminates the portion of the mechanical reel that displays the trace symbol when the mechanical reel displays the trace symbol. The mechanical reel which displayed the trace symbol can generate and display symbols for one or more subsequent spins because the light source indicates to the player that the mechanical reel previously displayed the trace symbol in the illuminated position. In one example embodiment, the designated quantity of trace symbols is determined by evaluating each spin of the mechanical reels to determine whether the symbols displayed for that spin of the mechanical reels includes the designated quantity of trace symbols. In another example embodiment, the designated quantity of trace symbols is determined by evaluating a plurality of spins of the mechanical reels to determine whether the symbols displayed of the plurality of spins for the mechanical reels include the designated quantity of trace symbols. That is, in this example embodiment, the displayed trace symbols are accumulated during the plurality of spins of the mechanical reels.

The gaming device disclosed herein thus provides the player with a new and exciting game that provides one or more lights source to illuminate respective portions of mechanical reels to indicate to a player that the respective mechanical reels have generated trace symbols. This indication enables the mechanical reels to subsequently spin while the gaming device continues to provide an indication to the player of the previously generated trace symbol. Such a configuration increases player excitement and enjoyment in playing the gaming device disclosed herein.

Additional features and advantages are described herein, and will be apparent from the following Detailed Description and figures.

DETAILED DESCRIPTION

The present disclosure may be implemented in various configurations for gaming machines, gaming devices, or gaming systems, including but not limited to: (1) a dedicated gaming machine, gaming device, or gaming system wherein the computerized instructions for controlling any games (which are provided by the gaming machine or gaming device) are provided with the gaming machine or gaming device prior to delivery to a gaming establishment; and (2) a changeable gaming machine, gaming device, or gaming system wherein the computerized instructions for controlling any games (which are provided by the gaming machine or gaming device) are downloadable to the gaming machine or gaming device through a data network after the gaming machine or gaming device is in a gaming establishment. In one embodiment, the computerized instructions for controlling any games are executed by at least one central server, central controller, or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller, or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
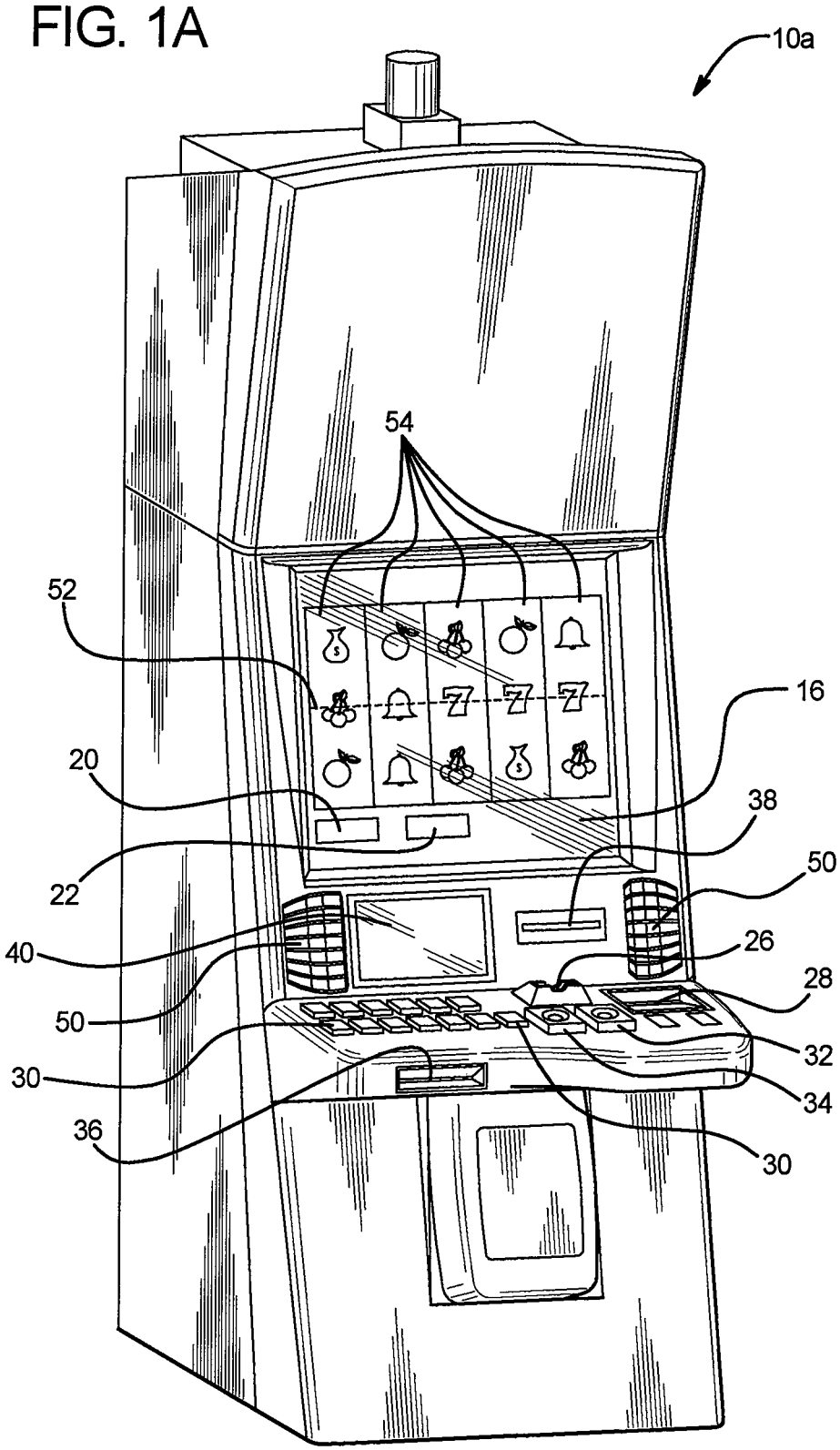
FIGS. 1A and 1B are front perspective views of alternative embodiments of gaming devices disclosed herein.
Figure 1B:
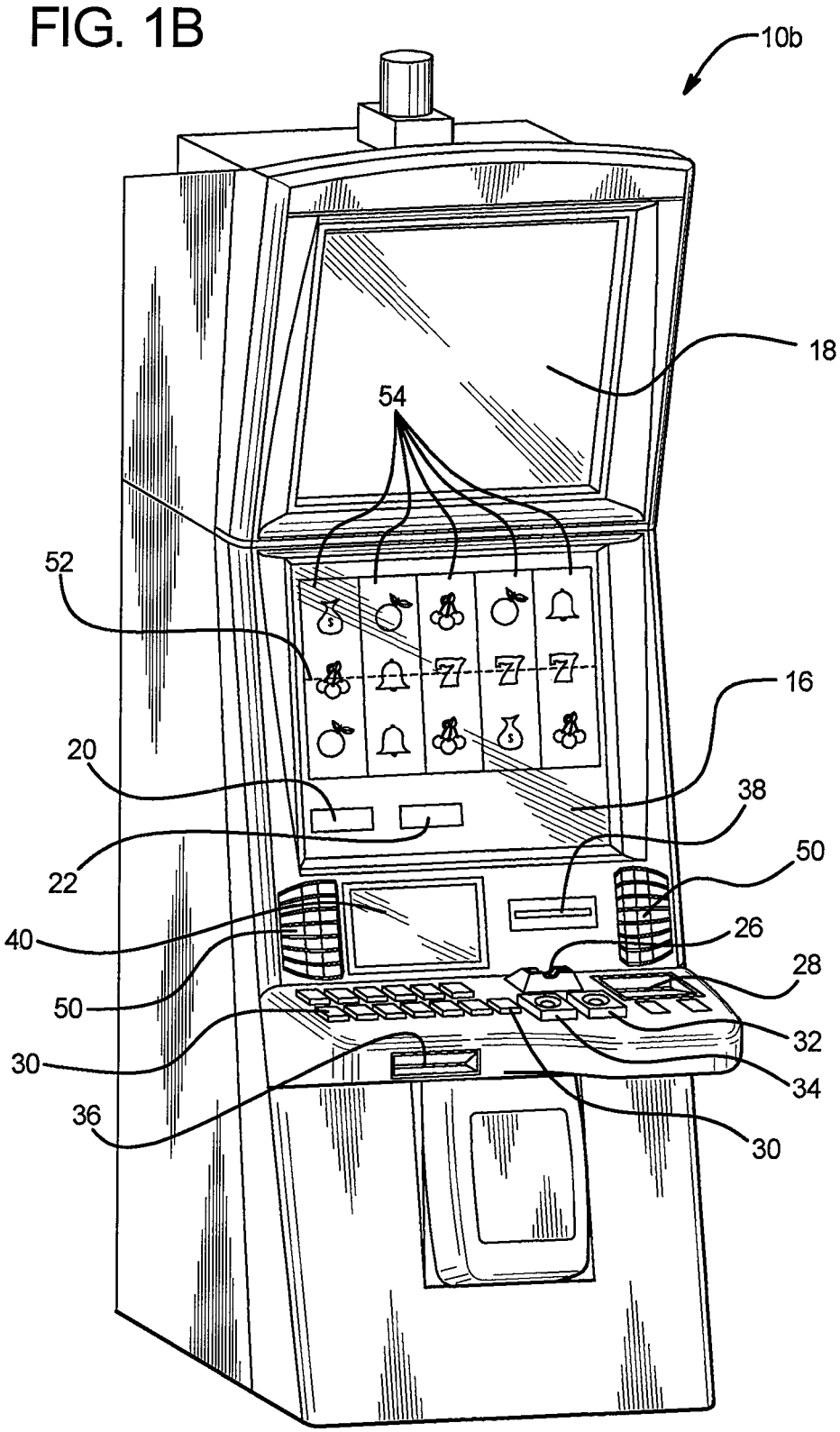

Referring now to the drawings, two example alternative embodiments of a gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing, or cabinet which provides support for a plurality of displays, inputs, controls, and other features of a conventional gaming machine. It is configured so that a player can operate it while standing or sitting. The gaming device can be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
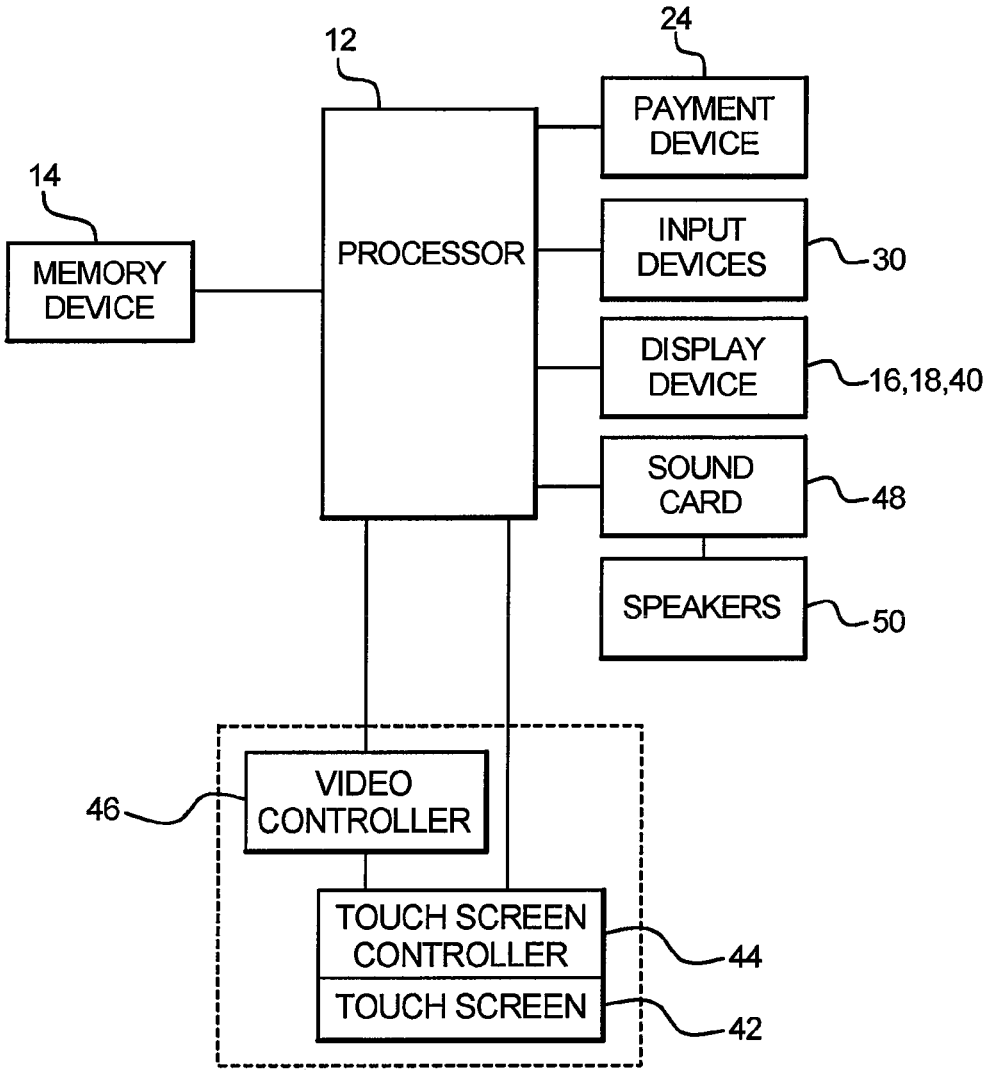
FIG. 2A is a schematic block diagram of the electronic configuration of one embodiment of a gaming device disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information, and applicable game rules that relate to the play of the gaming device. In one embodiment, the memory device includes random access memory (RAM), which can include non-volatile RAM (NVRAM), magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD, or USB memory device. In other embodiments, part or all of the program code and/or operating data described above can be downloaded to the memory device through a suitable network.

In one embodiment wherein present disclose employs reels in video form, an operator or a player can use such a removable memory device in a desktop computer, a laptop computer, a personal digital assistant (PDA), a portable computing device, or another computerized platform to implement the present disclosure. In one embodiment, the gaming device or gaming machine disclosed herein is operable over a wireless network, for example part of a wireless gaming system. In this embodiment, the gaming machine may be a hand-held device, a mobile device, or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted on the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance, or the equivalent. In one embodiment, the gaming device includes a bet display 22 which displays a player's amount wagered. In one embodiment, as described in more detail below, the gaming device includes a player tracking display 40 which displays information regarding a player's play tracking status.

In another embodiment wherein the reels are in video form, at least one display device may be a mobile display device, such as a PDA or tablet PC, that enables play of at least a portion of the primary or secondary game at a location remote from the gaming device.

In one embodiment wherein the reels are in video form, the display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual, or video reels and wheels, dynamic lighting, video images, images of people, characters, places, things, faces of cards, and the like.

In one embodiment, the symbols, images and indicia displayed on or of the display device are in mechanical form.

That is, the display device includes any electromechanical device, such as one or more mechanical objects, such as one or more rotatable wheels, reels, or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket, or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip, a coded magnetic strip or coded rewritable magnetic strip, wherein the programmed microchip or magnetic strips are coded with a player's identification, credit totals (or related data), and/or other relevant information. In another embodiment, a player may carry a portable device, such as a cell phone, a radio frequency identification tag, or any other suitable wireless device, which communicates a player's identification, credit totals (or related data), and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B, and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button, or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card or smart card, may be implemented in accordance with the gaming device disclosed herein.

In one embodiment, as mentioned above and as seen in FIG. 2A, one input device is a touch-screen 42 coupled with a touch-screen controller 44 or some other touch-sensitive display overlay to allow for player interaction with the images on the display. The touch-screen and the touch-screen controller are connected to a video controller 46. A player can make decisions and input signals into the gaming device by touching the touch-screen at the appropriate locations. One such input device is a conventional touch-screen button panel.

The gaming device may further include a plurality of communication ports for enabling communication of the processor with external peripherals, such as external video sources, expansion buses, game or other displays, a SCSI port, or a keypad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as by playing music for the primary and/or secondary game or by playing music for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming machine may include a sensor, such as a camera, in communication with the processor (and possibly controlled by the processor), that is selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera as well as to display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering game as the primary or base game. The gaming machine or device may include some or all of the features of conventional gaming machines or devices. The primary or base game may comprise any suitable reel-type game, card game, cascading or falling symbol game, number game, or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, displays the plurality of simulated video reels 54. Each reel 54 displays a plurality of indicia or symbols, such as bells, hearts, fruits, numbers, letters, bars, or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device that enables wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more than one or all of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of two cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to a quantity of awards being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two cards. Cards may be dealt as in a traditional game of cards or in the case of the gaming device, the cards may be randomly selected from a predetermined number of cards. If the player wishes to draw, the player selects the cards to hold via one or more input devices, such as by pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the number of credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand against a payout table and awards are provided to the player.

In one embodiment, a base or primary game may be a keno game wherein the gaming device displays a plurality of selectable indicia or numbers on at least one of the display devices. In this embodiment, the player selects at least one bit potentially a plurality of the selectable indicia or numbers via an input device such as a touch screen. The gaming device then displays a series of drawn numbers and determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or in a bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game, and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition occurs based on exceeding a certain amount of game play (such as number of games, number of credits, amount of time), or reaching a specified number of points earned during game play.

In another embodiment, the gaming device processor 12 or central controller 56 randomly provides the player one or more plays of one or more secondary games. In one such embodiment, the gaming device does not provide any apparent reason to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy-in for a bonus game is needed. That is, a player may not purchase entry into a bonus game; rather they must win or earn entry through play of the primary game, thus encouraging play of the primary game. In another embodiment, qualification of the bonus or secondary game is accomplished through a simple "buy-in" by the player—for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
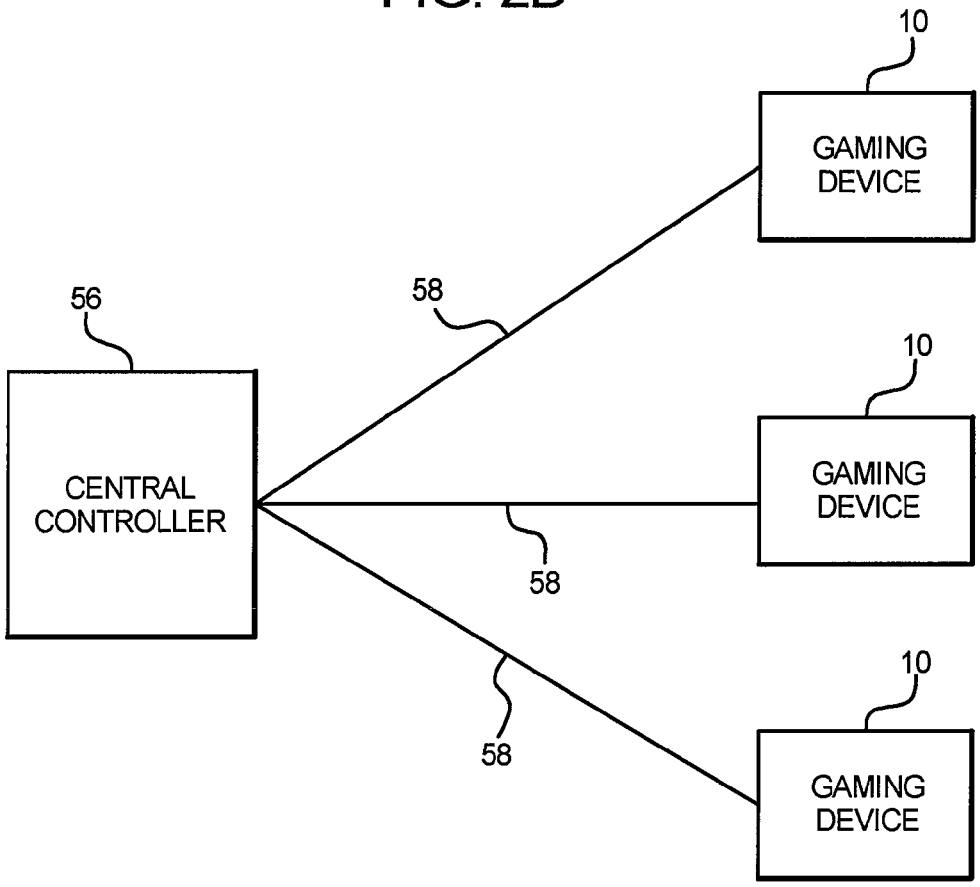
FIG. 2B is a schematic diagram of the central server in communication with a plurality of gaming devices in accordance with one embodiment of the gaming device disclosed herein.

In one embodiment, as illustrated in FIG. 2B, one or more of the gaming devices 10 are in communication with each other and/or at least one central controller 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands, or any other suitable data or signal between the individual gaming device and the central server. The gaming device processor is operable to execute such communicated events, messages, or commands in conjunction with the operation of the gaming device. Moreover, the processor of the central server is designed to transmit and receive events, messages, commands, or any other suitable data or signal between the central server and each of the individual gaming devices. The central server processor is operable to execute such communicated events, messages, or commands in conjunction with the operation of the central server. It should be appreciated that one, more or each of the functions of the central controller, central server or remote host as disclosed herein may be performed by one or more gaming device processors. It should be further appreciated that one, more or each of the functions of one or more gaming device processors as disclosed herein may be performed by the central controller, central server or remote host.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility, and the like.

In another embodiment, a predetermined game outcome value is determined for each of a plurality of linked or networked gaming devices based on the results of a bingo, keno, or lottery game. In this embodiment, each individual gaming device utilizes one or more bingo, keno, or lottery games to determine the predetermined game outcome value provided to the player for the interactive game played at that gaming device. In one embodiment, the bingo, keno, or lottery game is displayed to the player. In another embodiment, the bingo, keno or lottery game is not displayed to the player, but the results of the bingo, keno, or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card with each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game, and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of whether the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any player's gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer or other internet facilitator is available. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be achieved by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as by playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Trace Symbol Example Embodiments

Figure 3:
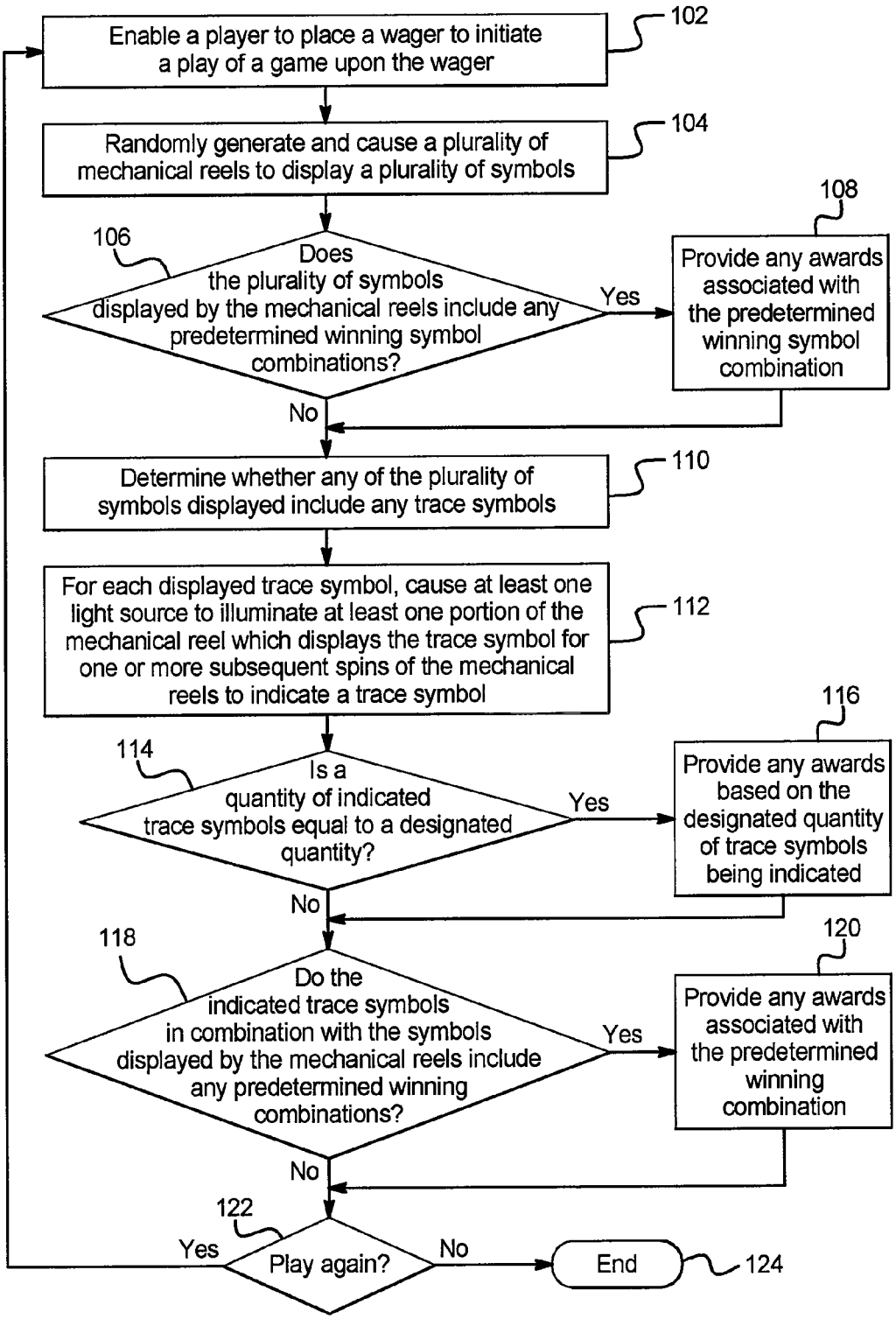
FIG. 3 is a flowchart of operation of one embodiment of the gaming device disclosed herein, illustrating an example of causing at least one light source to illuminate at least one portion of a mechanical reel when the mechanical reel displays a trace symbol, wherein the player is provided an award if the mechanical reels display a designated quantity of trace symbols for one or more spins of the mechanical reels, or if an indicated trace symbol in combination with symbols displayed by the mechanical reels include a predetermined winning combination.

FIG. 3 illustrates one example embodiment of the method of the present disclosure which causes at least one light source to illuminate at least one portion of a mechanical reel when the mechanical reel displays a trace symbol. In this example embodiment, the gaming device provides an award if the mechanical reels display a designated quantity of trace symbols for a designated quantity of spins of the mechanical reels. The gaming device also provides an award if an indicated trace symbol in combination with symbols displayed by the mechanical reels include a predetermined winning combination.

More specifically, the gaming device enables a player to place a wager to initiate a play of a game upon the placement of a wager as indicated by block 102. The gaming device then randomly generates and causes a plurality of mechanical reels to display a plurality of symbols as indicated by block 104.

As indicated by decision diamond 106, the gaming device determines whether the plurality of symbols displayed by the mechanical reels includes any predetermined winning symbol combinations. If the gaming device determines that the plurality of symbols displayed includes a predetermined winning symbol combination, the gaming device provides an award associated with the predetermined winning symbol combination as indicated by block 108.

The gaming device determines whether the plurality of symbols displayed includes any trace symbols as indicated by block 110. For each displayed trace symbol, the gaming device causes at least one light source to illuminate at least one portion of the mechanical reel which displays the trace symbol for one or more subsequent spins of the mechanical reels to indicate a trace symbol as shown by block 112. In one embodiment, the gaming device determines a designated number of games remaining in which previously displayed trace symbols are maintained for subsequent spins of the mechanical reels. In one example embodiment, the designated number of games is based on a wager amount.

In this example embodiment, the gaming device determines whether the quantity of indicated trace symbols is equal to a designated quantity as indicated by decision diamond 114. If the gaming device determines that the quantity of indicated trace symbols is equal to the designated quantity, the gaming device provides an award based on the designated quantity of symbols being indicated as shown in block 116.

As indicated by decision diamond 118, the gaming device determines whether the indicated trace symbols in combination with the symbols displayed by the mechanical reels include any predetermined winning combinations. If the gaming device determines that the indicated trace symbols in combination with the symbols displayed by the mechanical reels include a predetermined winning combination, the gaming device provides an award associated with the predetermined winning combination as indicated by block 120.

As indicated by decision diamond 122, if the player chooses to play again the gaming device repeats the process starting at block 102. The player, therefore, has the opportunity to place another wager to initiate another play of the game. If the player chooses not to play again, the process ends as indicated by block 124.

Figure 4:
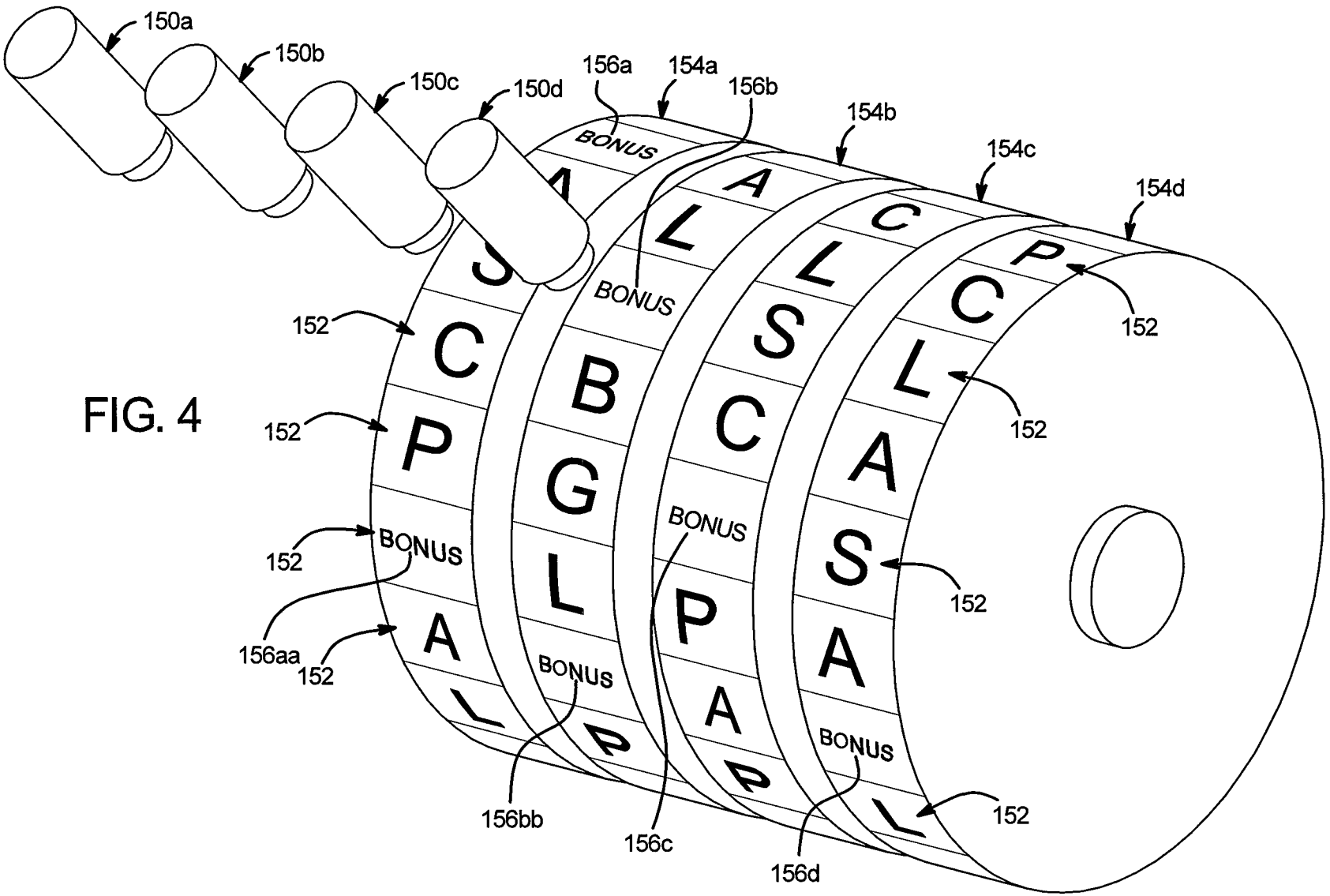
FIG. 4 is a diagrammatic front perspective view of one embodiment of the gaming device disclosed herein, illustrating a plurality of light sources and a plurality of mechanical reels.

Referring now to FIG. 4, this example embodiment generally shows an example embodiment of a plurality of light sources and the plurality of mechanical reels. More specifically, as illustrated in FIG. 4, the gaming device includes a plurality of mechanical reels 154*a*, 154*b*, 154*c*, and 154*d*, wherein each of the mechanical reels include a plurality of symbols 152 which include at least one trace symbol 154. In this example embodiment, each trace symbol included on the mechanical reels is illustrated as a "BONUS" symbol. The gaming device also includes a plurality of light sources 150*a*, 150*b*, 150*c*, and 150*d* respectively associated with the mechanical reels 154*a*, 154*b*, 154*c*, and 154*d*. In this example embodiment, light source 150*a* illuminates at least one portion of the mechanical reel 154*a* when the mechanical reel 154*a* generates and displays either the trace symbol 156*a* or 156*aa* to the player. Light source 150*b* illuminates at least one portion of the mechanical reel 154*b* when the mechanical reel 154*b* generates and displays either the trace symbol 156*b* or 156*bb* to the player. Light source 150*c* illuminates at least one portion of the mechanical reel 154*c* when the mechanical reel 154*c* generates and displays the trace symbol 156*c* to the player. Light source 150*d* illuminates at least one portion of the mechanical reel 154*d* when the mechanical reel 154*d* generates and displays the trace symbol 156*d* to the player.

Referring now to FIGS. 5A to 5E, this example embodiment generally illustrates the gaming device employing trace symbols and the light sources in an example primary game. Each trace symbol displayed functions as a wild symbol for five subsequent spins of the mechanical reels. In this example embodiment, the gaming device provides an award when an indicated trace symbol in combination with symbols displayed by the mechanical reels include a predetermined winning combination.

It should be appreciated that the mechanical reels in FIGS. 5A to 5E (and FIGS. 6A to 6G) are shown in a diagrammatic view for best illustrating the functionality of the game play in association with mechanical reels. It should be appreciated that the illumination of the reels can be configured in multiple different manners for example as described below in FIGS. 7 to 12.

Figure 5A:
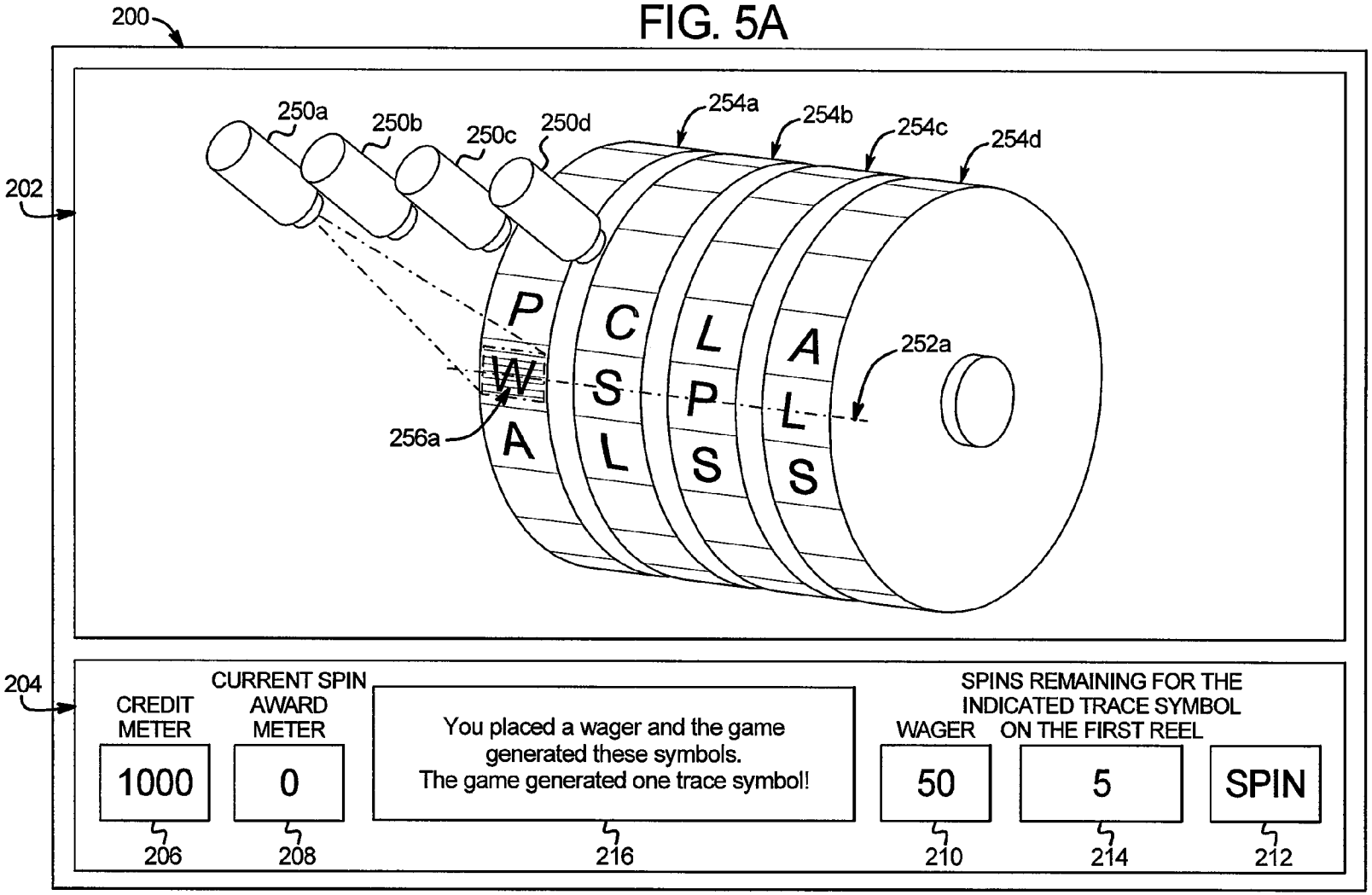
FIGS. 5A, 5B, 5C, 5D, 5E are diagrammatic front views of one embodiment of the display device of the gaming device disclosed herein, illustrating providing an award to the player when an indicated trace symbol in combination with symbols displayed by the mechanical reels include a winning combination, wherein each trace symbol displayed functions as a wild symbol for five subsequent spins of the mechanical reels.

As illustrated in FIG. 5A, the gaming device includes a display device 200 which includes a first display device 202 associated with a plurality of light sources 250*a*, 250*b*, 250*c*, and 250*d* and a plurality reels 254*a*, 254*b*, 254*c*, and 254*d*. The display device 200 also includes a second display device 204 which is associated with a plurality of input and output devices discussed in more detail below.

The second display device 204 displays a credit meter 206. The credit meter 206 displays how much money (i.e., in credits) has been deposited by the player, minus how much money has been wagered by the player, plus how much money has been won by the player. The credit meter 206 illustrated in FIG. 5A indicates that the player has 1000 credits.

The second display device 204 displays a current spin award meter 208. The current spin award meter 208 displays how much money has been won by the player for a play of the game. For reasons described below, the current award meter 208 indicates that the player has not won any money for the play of the game illustrated in FIG. 5A.

The second display device 204 also displays a wager meter 210. The wager meter 210 displays the amount of money that the player has wagered for a play of the game. For the play of the game illustrate in FIG. 5B, the wager meter 210 indicates that the player wagered fifty credits.

The display device 204 also displays a spin button 212. After the player places a wager for a play of the game, the player is enabled to select the spin button 212 which causes the gaming device to display that play of the game.

As illustrated in FIG. 5A, after the player placed a wager of fifty credits on payline 252*a* for a play of the game, the gaming device randomly generates and causes the plurality of mechanical reels 254*a*, 254*b*, 254*c*, and 254*d* to display a plurality of symbols for the play of the game. In FIG. 5A, the plurality of symbols displayed includes trace symbol 256*a*. In this example embodiment, each trace symbol included on the mechanical reels is illustrated as a "W" symbol. In this example embodiment, each trace symbol functions as a wild symbol which substitutes for any symbol on the mechanical reels. For the displayed trace symbol 256*a*, the gaming device causes the light source 250*a* to illuminate a portion of the mechanical reel 254*a* to indicate the trace symbol 256*a* to the player for five subsequent spins of the mechanical reels. In this example, the portion of the mechanical reel that is illuminated is the symbol display area which includes the trace symbol 256*a*. In this example, the illuminated color is blue. The second display device 204 displays a spins remaining for the indicated trace symbol on the first reel meter 214 which indicates to the player that the indicated trace symbol 256*a* will remain indicated for five subsequent spins of the mechanical reels.

It should be appreciated that in FIG. 5A, the player is not provided with an award based on the indicated trace symbol 256*a* in combination with the plurality of symbols displayed by the mechanical reels because this combination does not include any predetermined winning combinations. That is, in this example, the combination of the indicated trace symbol 256*a* in combination with "S-P-L" on payline 252*a* is not a predetermined winning combination. The gaming device provides a visual message 216 informing the player of generated trace symbol. An appropriate message such as "YOU PLACED A WAGER AND THE GAME GENERATED THESE SYMBOLS. THE GAME GENERATED ONE TRACE SYMBOL!" is provided to the player visually, such as in the message display 216, or through other suitable audio or audiovisual displays.

Figure 5B:
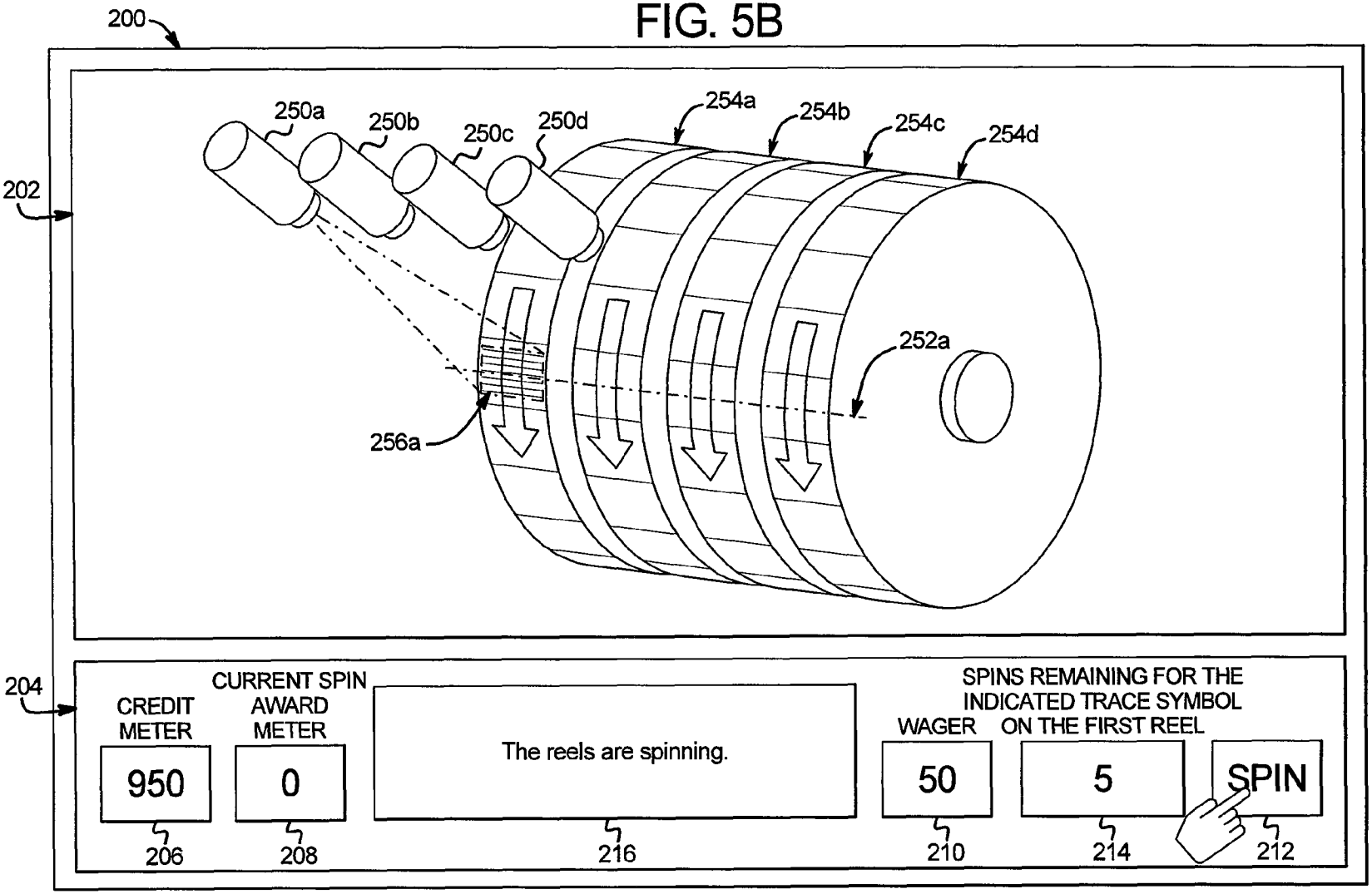

As illustrated in FIG. 5B, the wager meter 210 indicates that the player places a wager of fifty credits and selects the spin button 212 to initiate a play of the game. The number of credits shown in the credit meter 206 decreases by fifty (i.e., the amount of credits wagered), and the number of credits shown in the wager meter 210 indicates a wager of fifty credits. Accordingly, the credit meter 206 displays the player's remaining credits (i.e., 950) after using fifty credits to make the wager. In this example, the player wagered fifty credits on payline 252*a*. As illustrated in FIG. 5B, upon receiving the selection of the spin button 212, the gaming device causes the mechanical reels 254*a*, 254*b*, 254*c*, and 254*d* to spin. In this example embodiment, the light source 250*a* continues to illuminate the portion of mechanical reel 254*a* to indicate the trace symbol 256*a* (which was displayed during the previous spin of the mechanical reels) to the player while all the mechanical reels spin. An appropriate message such as "THE REELS ARE SPINNING" is provided to the player visually, such as in the message display 216, or through other suitable audio or audiovisual displays.

Figure 5C:
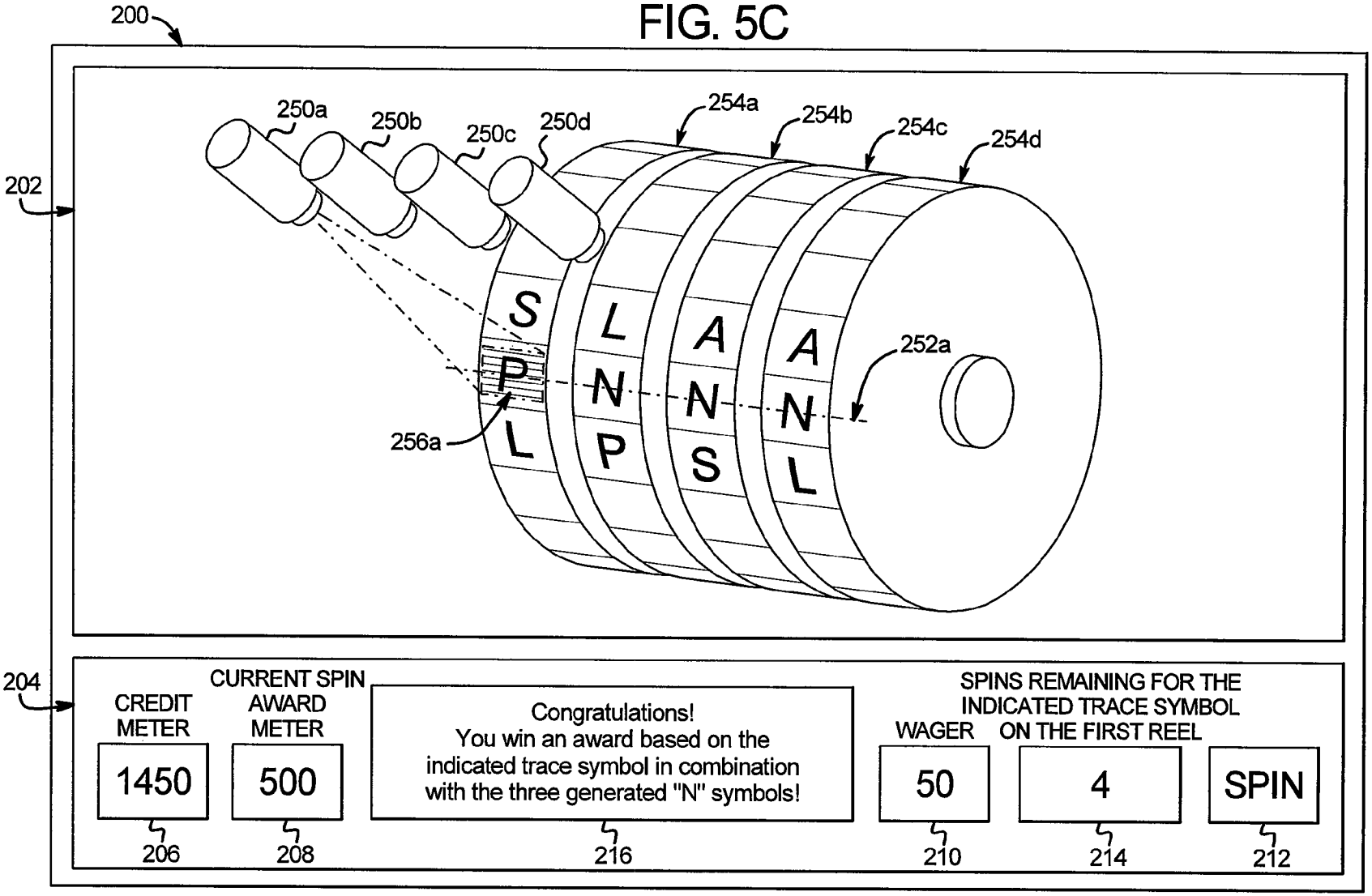

As illustrated in FIG. 5C, the gaming device randomly generates and causes the mechanical reels 254*a*, 254*b*, 254*c*, and 254*d* to display a plurality of symbols. In FIG. 5C, the gaming device decreases the quantity of spins remaining in which the indicated trace symbol 256*a* will remain indicated. That is, the gaming device decreases the remaining spins from five to four as indicated by the spins remaining for the indicated trace symbol on the first reel meter 214. The gaming device decreases the remaining spins regardless of the generated "P" symbol on reel 254*a*.

In this example embodiment, each trace symbol displayed is associated with a remaining spins meter. That is, for each trace symbol displayed the gaming device displays an associated remaining spins meter which initially indicates that the displayed trace remains indicated for five subsequent spins. It should be appreciated that in one embodiment each mechanical reel can be associated with a remaining spins meter. In this embodiment, for each reel that displays a trace symbol the gaming device displays an associated remaining spins meter which initially indicates a designated remaining number of spins for the trace symbol displayed to remain indicated to the player for that reel.

For wagered on payline 252*a*, the gaming device determines that the indicated trace symbol 256*a* in combination with the symbols displayed by the mechanical reels includes a predetermined winning combination. That is, the indicated trace symbol 256*a* (which functions as a wild symbol) in combination with the symbols "N-N-N" on payline 252*a* is a winning combination (i.e., four "N" symbols). As indicated by the current spin award meter 208, the gaming device provides the player with a 500 credit award which is associated with the predetermined winning combination of four "N" symbols generated on payline 252*a*. An appropriate message such as "CONGRATULATIONS! YOU WIN AN AWARD BASED ON THE INDICATED TRACE SYMBOL IN COMBINATION WITH THE THREE GENERATED N SYMBOLS!" is provided to the player visually, such as in the message display 216, or through other suitable audio or audiovisual displays.

Figure 5D:
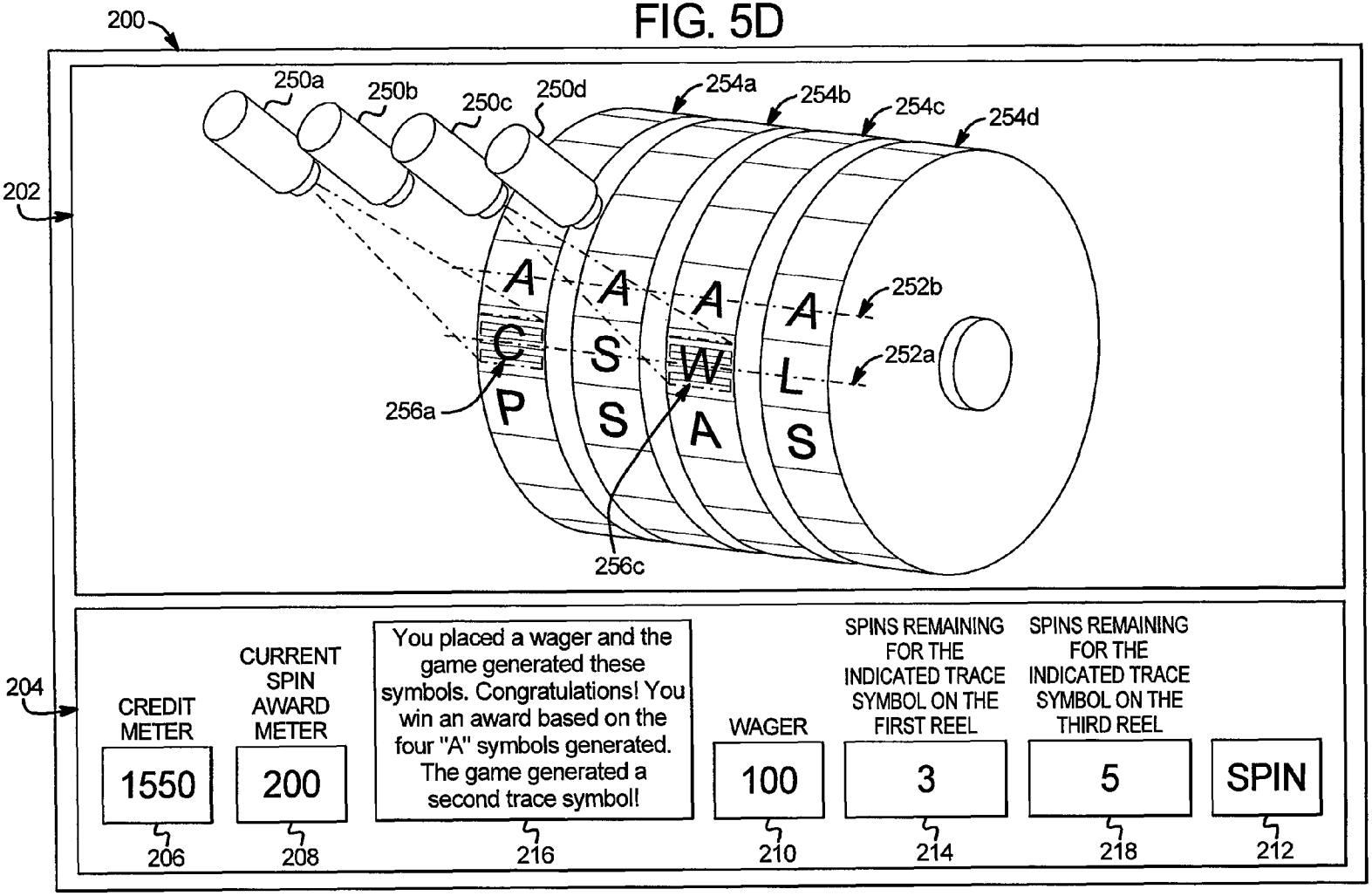

As illustrated in FIG. 5D, after the player places a wager of one hundred credits for a play of the game (i.e., fifty credits on each of the paylines 252*a* and 252*b*), the gaming device randomly generates and causes the plurality of mechanical reels 254*a*, 254*b*, 254*c*, and 254*d* to display a plurality of symbols for the play of the game. The gaming device determines that the plurality of symbols displayed by the mechanical reels includes a predetermined winning symbol combination. That is, the symbol combination of "A-A-A-A" on payline 252*b* is a predetermined winning symbol combination. As indicated by the current spin award meter 208, the gaming device provides the player with a 200 credit award which is associated with the predetermined winning combination of four "A" symbols generated for the payline. It should appreciated that because the gaming device causes the light source to illuminate the previously displayed trace symbol 256*a* to indicate to the player that the mechanical reel previously displayed the trace symbol 256*a*, the gaming device is enabled to spin and generate symbols for subsequent spins which enables the gaming device to provide additional awards based on different predetermined winning symbol combinations. That is, when a trace symbol is maintained for subsequent spins by illuminating portions of a mechanical reel, the mechanical reel which displayed the trace symbol can spin for one or more subsequent spins and thus different symbols can be generated on a plurality of different paylines.

The wager meter 210 displays the number 100, and the credit meter 206 displays the player's remaining credits after using 100 credits to make the wager and receiving the 100 credit award. That is, the credit meter 206 shows the number 1550 to reflect the player's remaining credits. The gaming device decreases the quantity of spins remaining in which the indicated trace symbol will function as a wild symbol. That is, the gaming device decreases the remaining spins from four to three as indicated by the spins remaining for the first indicated trace symbol meter 214.

In FIG. 5D, the plurality of symbols displayed to the player includes trace symbol 256*c*. For the displayed trace symbol 256*c*, the gaming device causes the light source 250*c* to illuminate a portion of the mechanical reel 254*c* to indicate the trace symbol 256*c* to the player for five subsequent spins of the mechanical reels. In FIG. 5D, the portion of the mechanical reel 254*c* that is illuminated is the symbol display area which includes the trace symbol 256*c*. The second display device 204 displays a spins remaining for the indicated trace symbol on the third reel meter 218 which indicates to the player that the indicated trace symbol 256*c* will remain indicated and function as a wild symbol for five subsequent spins of the mechanical reels.

It should also be appreciated that in FIG. 5D, the player is not provided with an award based on the indicated trace symbols 256*a* and 256*c* in combination with the plurality of symbols displayed by the mechanical reels because the indicated trace symbols 256*a* and 256*c* in combination with the plurality of symbols displayed by the mechanical reels do not include any winning combinations. That is, the indicated trace symbols 256*a* and 256*c* in combination with the symbol "S" (i.e., three "S" symbols) or the symbol "L" (i.e., three "L" symbols) on payline 252*a* is not a predetermined winning symbol combination.

The second display device 204 displays an visual message 216 informing the player of generated trace symbol. An appropriate message such as "YOU PLACED A WAGER AND THE GAME GENERATED THESE SYMBOLS. CONGRATULATIONS! YOU WIN AN AWARD BASED ON THE FOUR "A" SYMBOLS GENERATED. THE GAME GENERATED A SECOND TRACE SYMBOL!" is provided to the player visually, such as in the message display 216, or through other suitable audio or audiovisual displays.

Figure 5E:
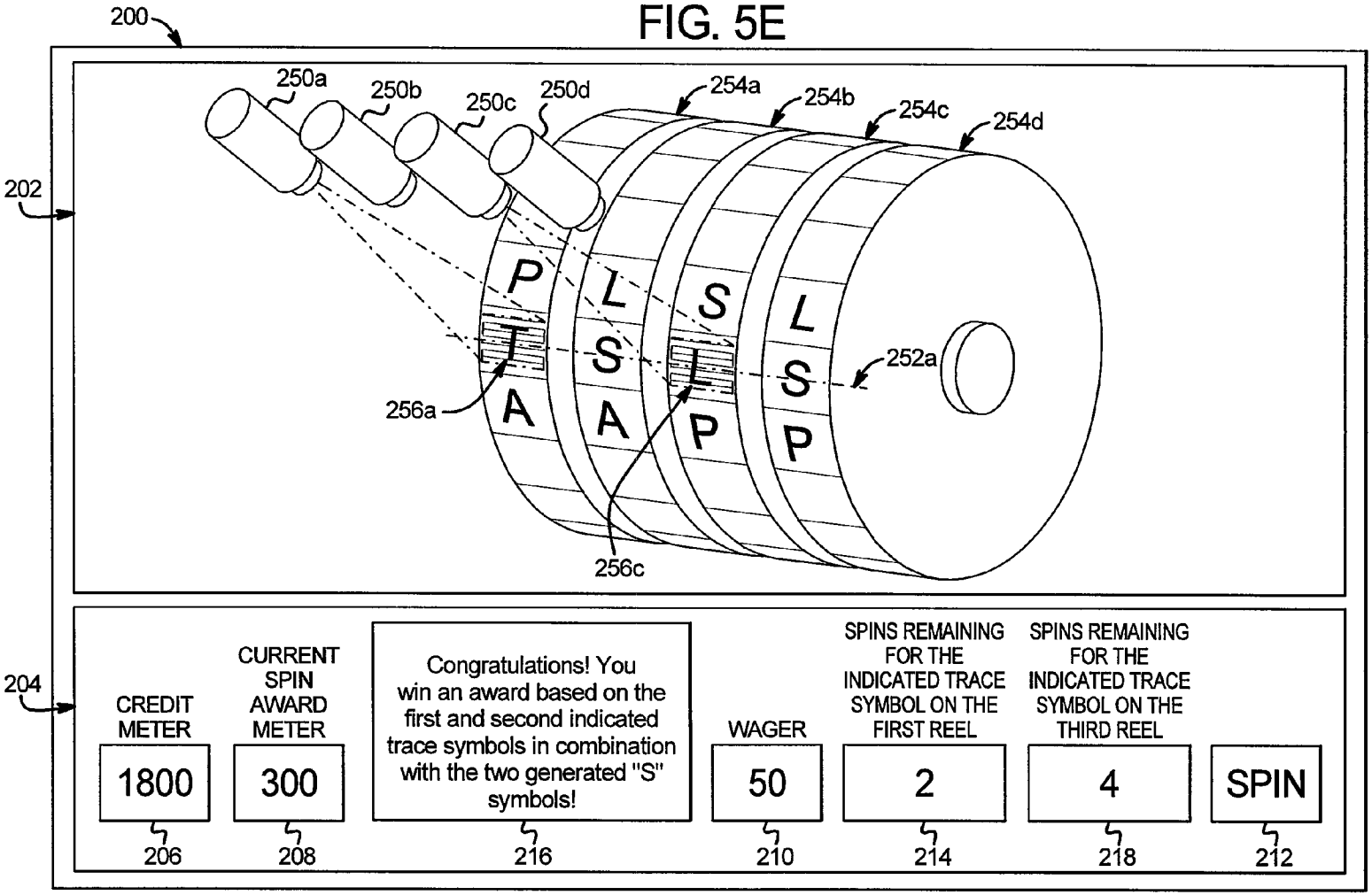

As illustrated in FIG. 5E, after the player places a wager of fifty credits on payline 252*a* for a play of the game, the gaming device randomly generates and causes the plurality of mechanical reels 254*a*, 254*b*, 254*c*, and 254*d* to display a plurality of symbols for the play of the game. The wager meter 210 displays the number fifty, and the credit meter 206 subtracts the player's wager from the player's remaining credits after using fifty credits to make the wager. The gaming device decreases the quantity of spins remaining for each of the indicated trace symbols. That is, the gaming device decrease the remaining spins for the indicated trace symbol on the first reel from three to two as indicated by the spins remaining for the indicated trace symbol on the first reel meter 214 and the remaining spins for the indicated trace symbol on the third reel from five to four as indicated by the spins remaining for the indicated trace symbol on the third reel meter 218.

For wagered on payline 252*a*, the gaming device determines that the indicated trace symbols 256*a* and 256*c* in combination with the symbols displayed by the mechanical reels includes a predetermined winning combination. That is, the indicated trace symbols 256*a* and 256*c* in combination with the symbols "S-S" (i.e., four S symbols) on payline 252*a* is a predetermined winning combination. As indicated by the current spin award meter 208, the gaming device provides a 300 credit award which is associated with the predetermined winning combination of four "S" symbols generated for the payline. An appropriate message such as "CONGRATULATIONS! YOU WIN AN AWARD BASED ON THE FIRST AND SECOND INDICATED TRACE SYMBOLS IN COMBINATION WITH THE TWO GENERATED S SYMBOLS!" is provided to the player visually, such as in the message display 216, or through other suitable audio or audiovisual displays.

In this example embodiment, the respective amount of spins remaining for each of the indicated trace symbols 256*a* and 256*c* continue to decrease after each play of a game regardless of the gaming device providing an award to the player based on the predetermined winning combination. That is, the gaming device will continue to illuminate the trace symbol 256*a* for two remaining spins as indicated by the spins remaining for the indicated trace symbol on the first reel meter 214, and the gaming device will continue to illuminate the trace symbol 256*c* for four remaining spins as indicated by the indicated trace symbol on the third reel meter 218. In one alternative embodiment, the gaming device causes any light sources which are indicating any trace symbols to clear any indication of the trace symbols to the player after the gaming device provides the player an award.

In this example embodiment, for each indicated trace symbol the gaming device causes the illuminated symbol position to function as wild symbol. In one alternative embodiment, the gaming device limits the amount of trace symbols that can function as wild symbols for a spin of the mechanical reels.

Although this example embodiment is described as being employed in a primary game, it should be appreciated that in one embodiment, this example embodiment may be employed in a secondary or bonus game.

Referring now to FIGS. 6A to 6G, this example embodiment generally illustrates the gaming device employing the trace symbols and light sources in an example secondary game. When the secondary game triggering event occurs, the gaming device provides the player with an award of ten free spins of the mechanical reels. The secondary game includes a plurality of levels associated with different colors in which the player tries to advance through. For each level, the gaming device provides an award when the quantity of indicated trace symbols for each mechanical reel is equal to a designated number.

Figure 6A:
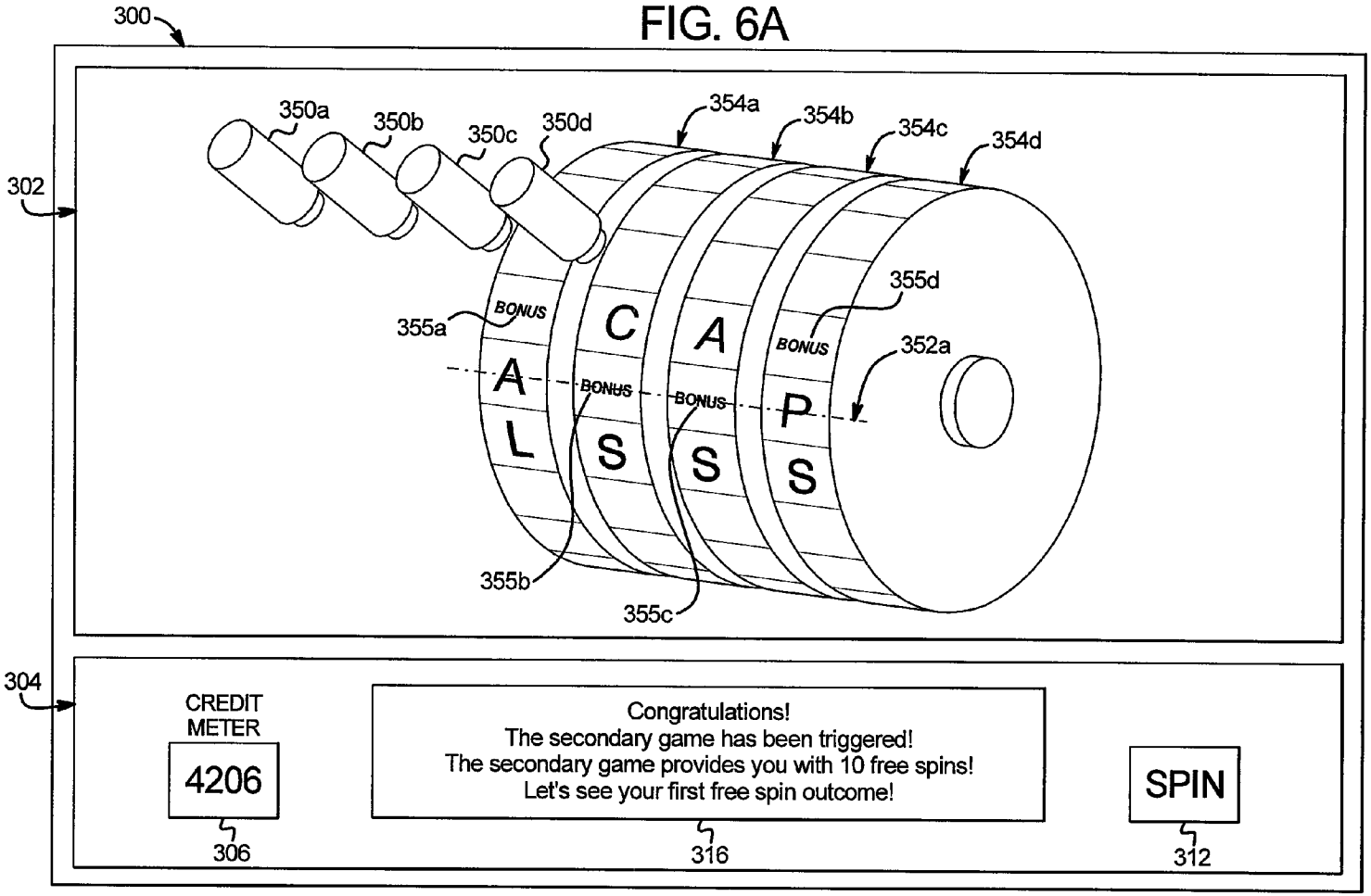
FIGS. 6A, 6B, 6C, 6D, 6E, 6F, and 6G are diagrammatic front views of one embodiment of the display device of the gaming device disclosed herein, illustrating providing an award to the player when for each of the mechanical reels the quantity of indicated trace symbols is equal to a designated number.

As illustrated in FIG. 6A, the gaming device includes a display device 300 which includes a first display device 302 associated with a plurality of light sources 350*a*, 350*b*, 350*c*, and 350*d* and a plurality reels 354*a*, 354*b*, 354*c*, and 354*d*. The display device 300 also includes a second display device 304 which is associated with a plurality of input and output devices which include a credit meter 304, a message display 316, and a spin button 312.

More specifically, as illustrated in FIG. 6A, after the player placed a wager of fifty credits a play of a primary game, the gaming device randomly generated and caused the plurality of mechanical reels 354*a*, 354*b*, 354*c*, and 354*d* to display a plurality of symbols. In FIG. 6A, the symbols generated by the mechanical reels include a secondary game triggering event. In this example embodiment, the secondary game triggering event occurs because each of the mechanical reels generates and displays a secondary game triggering symbol for the play of the game (i.e., the generation of the "BONUS" symbol for each of the mechanical reels). The "BONUS" symbols 355*a*, 355*b*, 355*c*, and 355*d* displayed on each of the mechanical reels cause the gaming device to provide a secondary game to the player which includes ten free spins of the mechanical reels. An appropriate message such as "CONGRATULATIONS! THE SECONDARY GAME HAS BEEN TRIGGERED! THE SECONDARY GAME PROVIDES YOU WITH 10 FREE SPINS OF THE MECHANICAL REELS! LET'S SEE YOUR FIRST SPIN OUTCOME!" is provided to the player visually, such as in the message display, or through other suitable audio or audiovisual displays.

Figure 6B:
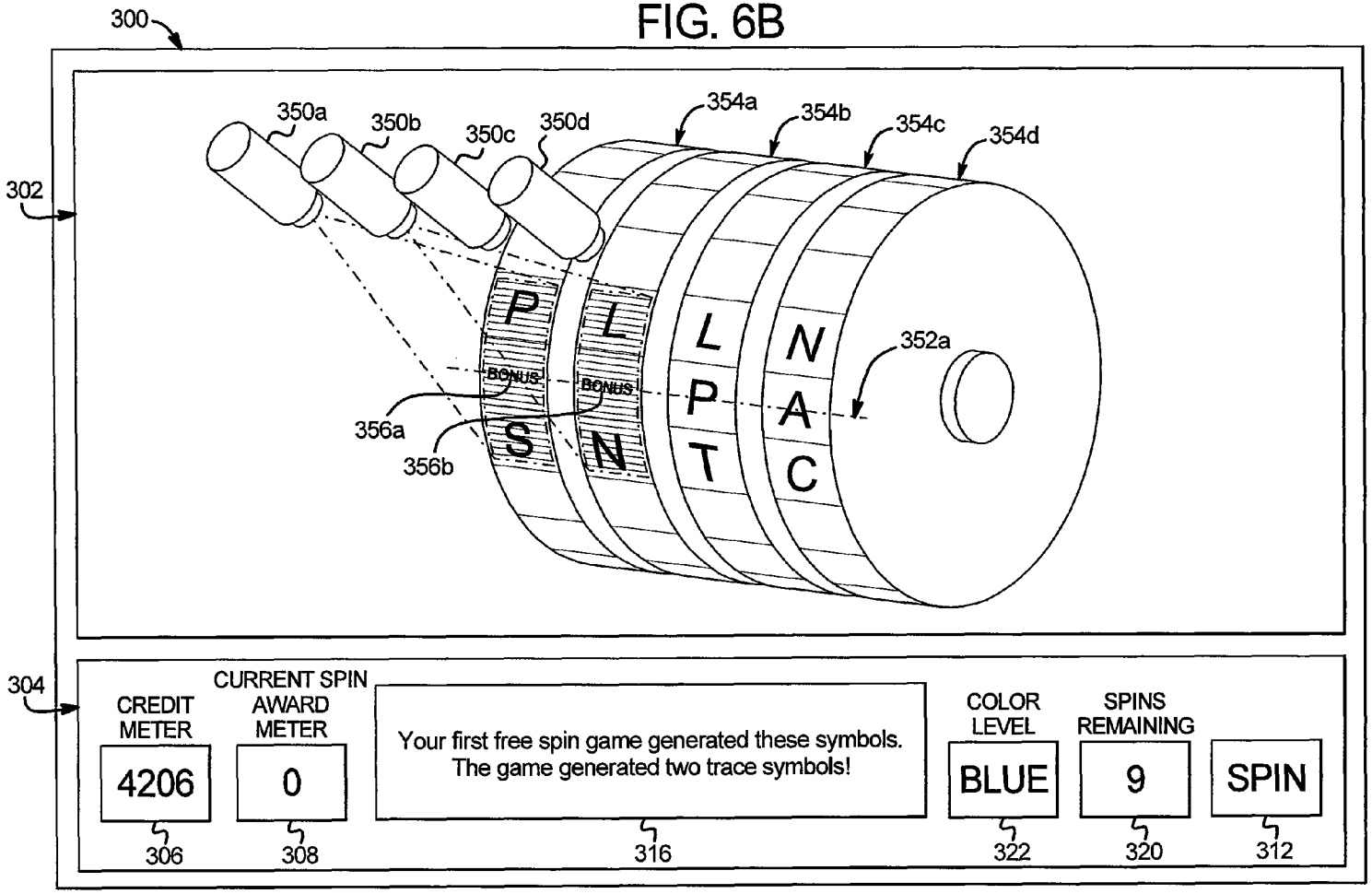

As illustrated in FIG. 6B, when the gaming device displays the first free spin of the mechanical reels, the second display device 304 displays a spins remaining meter 320. The spins remaining meter 320 displays how many free spins of the mechanical reels remain to be provided to the player. The second display device 304 also displays a current spin award meter 308.

The secondary game provided to the player includes a plurality of levels associated with different colors in which the player tries to progress through. In this example embodiment, for each level, the gaming device provides the player an award if each of the mechanical reels display at least one trace symbol for that level during the play of the provided free spins. More specifically, in this example embodiment, the provided secondary game includes four levels associated with the colors blue, yellow, green, and red, respectively. The gaming device includes a pay table which associates each level with a predetermined award value. In this example embodiment, the following pay table illustrates each predetermined award level associated with each level.

| Level | Award (credits) |
|---|---|
| Blue | 500 |
| Yellow | 1000 |
| Green | 2000 |
| Red | 4000 |

That is, for the blue level, if each of the mechanical reels display a trace symbol, the gaming device provides the player with an award of 500 credits. For the yellow level, if each of the mechanical reels display a trace symbol, the gaming device provides the player with an award of 1000 credits. For the green level, if each of the mechanical reels display a trace symbol, the gaming device provides the player with an award of 2000 credits. For the red level, if each of the mechanical reels display a trace symbol, the gaming device provides the player with an award of 4000 credits. In one alternative embodiment, the gaming device provides an award to the player based on the highest level the player progressed through.

In FIG. 6B, after the player selects the spin button 312, the gaming device randomly generates and causes the mechanical reels to display a plurality of symbols for the first provided free spin game. For the first provided free spin, the second display device 304 displays a color level indicator 322 which displays the level associated with the play of the game. In this example, the color level indicator 322 indicates that the first provided free spin game is associated with the blue level. If each of the plurality of mechanical reels generates and displays a trace symbol, the gaming device increases the level from the blue level to the yellow level.

In FIG. 6B, the plurality of symbols displayed by the mechanical reels include trace symbols 356*a* and 356*b*. In this example embodiment, each trace symbol included on the mechanical reels is illustrated as a "BONUS" symbol. For the trace symbol 356*a*, the gaming device causes the light source 350*a* to illuminate a portion of the mechanical reel 354*a* to indicate to the player that the mechanical reel 354*a* displayed trace symbol 356*a* for one or more subsequent spins of the mechanical reels. For the trace symbol 356*b*, the gaming device causes the light source 350*b* to illuminate a portion of the mechanical reel 354*b* to indicate to the player that mechanical reel 354*b* displayed trace symbol 356*b* for one or more subsequent spins of the mechanical reels. In FIG. 6B, the light sources 350*a*, 350*b*, 350*c*, and 350*d* are configured to respectively illuminate each portion of the reels using the color blue. As illustrated in FIG. 6B, in this example embodiment, for each trace symbol displayed to the player the gaming device causes the respective light source to illuminate all of the portion of the mechanical reel which is displayed to the player. An appropriate message such as "YOUR FIRST FREE SPIN GAME GENERATED THESE SYMBOLS. THE GAME GENERATED TWO TRACE SYMBOLS!" is provided to the player visually, such as in the message display 316, or through other suitable audio or audiovisual displays.

Figure 6C:
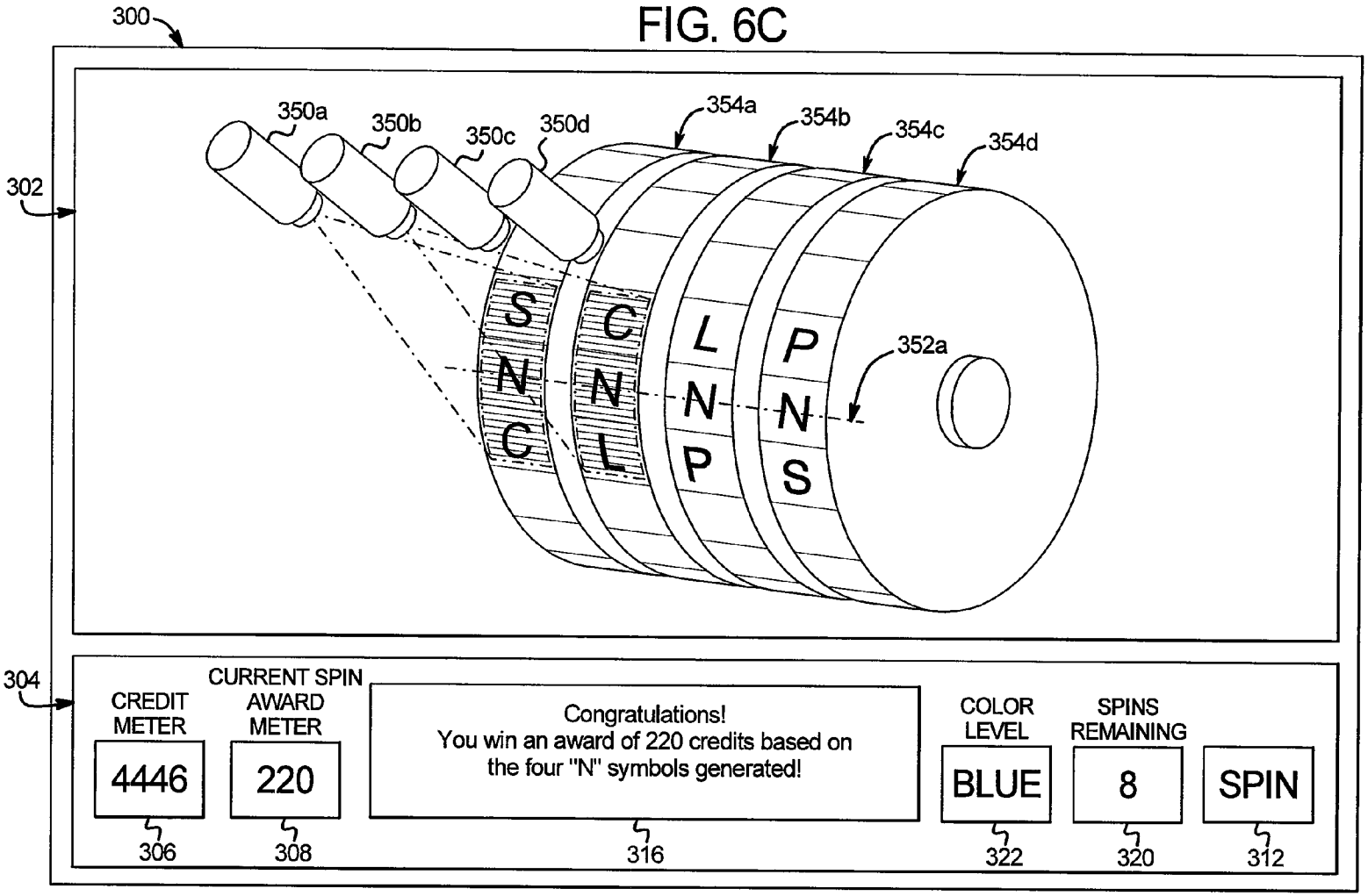

In FIG. 6C, after the player selects the spin button 320, the gaming device randomly generates and causes the mechanical reels to display a plurality of symbols for the second provided free spin game. The gaming device decreases the number of free spins remaining to provide to the player. That is, the gaming device decreases the remaining number of free spins from nine to eight as indicated by the spins remaining meter 320.

In FIG. 6C, the gaming device determines that the plurality of symbols displayed by the mechanical reels includes a predetermined winning symbol combination. That is, the symbol combination of "N-N-N-N" on payline 352*a* is a predetermined winning symbol combination. As indicated by the current spin award meter 308, the gaming device provides the player with a 220 credit award which is associated with the predetermined winning combination of four "N" symbols generated for the payline. An appropriate message such as "CONGRATULATIONS! YOU WIN AN AWARD OF 220 CREDITS BASED ON THE FOUR N SYMBOLS GENERATED!" is provided to the player visually, such as in the message display 316, or through other suitable audio or audiovisual displays.

Figure 6D:
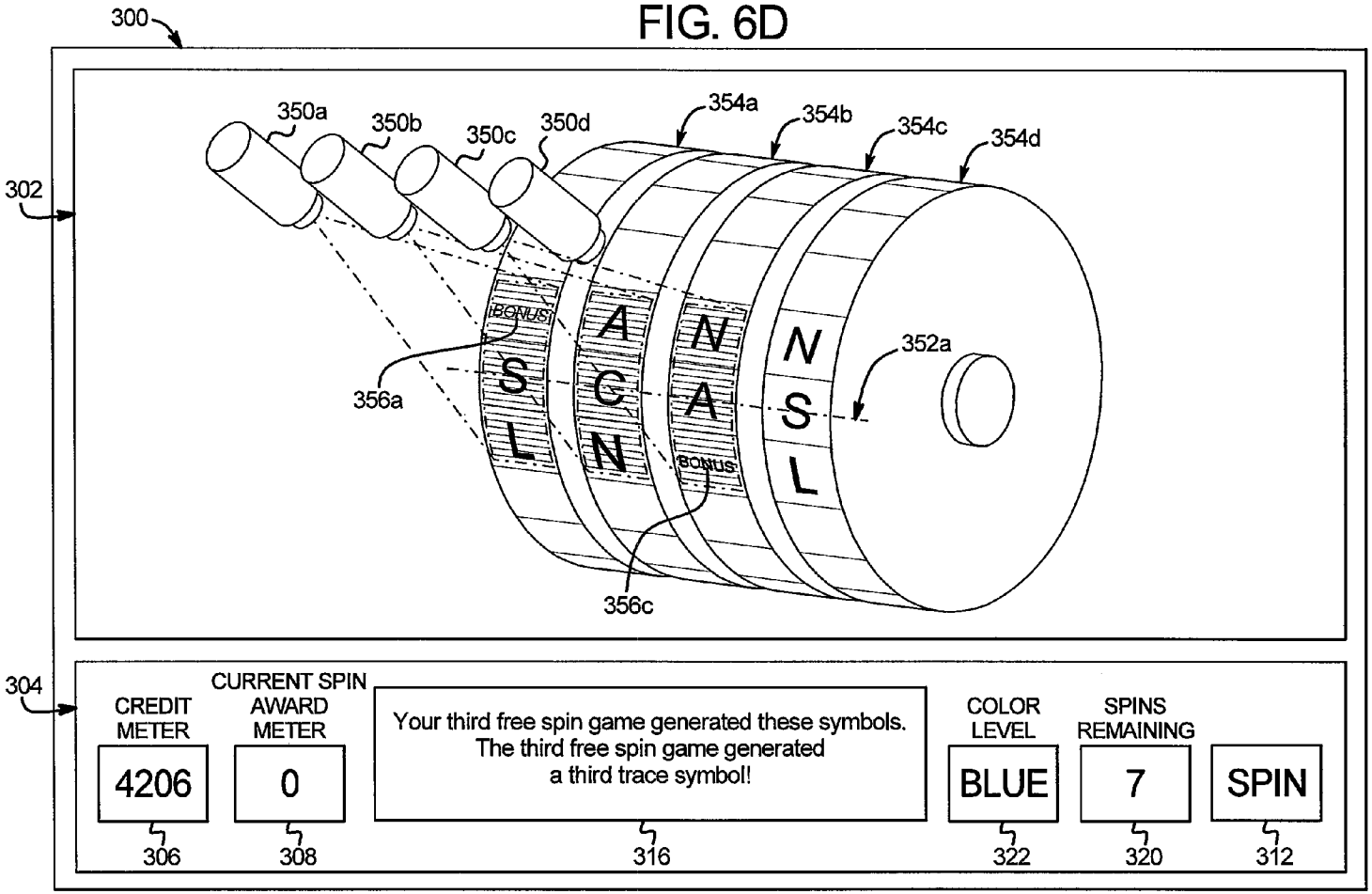

In FIG. 6D, after the player selects the spin button 312, the gaming device randomly generates and causes the mechanical reels to display a plurality of symbols for the third provided free spin game. The gaming device decreases the number of free spins remaining to provide to the player. That is, the gaming device decreases the remaining number of free spins from eight to seven as indicated by the spins remaining meter 320.

In FIG. 6D, the plurality of symbols displayed includes trace symbols 356*a* and 356*c*. For the trace symbol 356*c*, the gaming device causes the light source 350*c* to illuminate a portion of the mechanical reel 354*c* to indicate to the player that the mechanical reel 354*c* displayed trace symbol 356*c* for one or more subsequent spins of the mechanical reels. It should be appreciated that although mechanical reel 354*a* displays trace symbol 356*a*, the mechanical reel 354*a* has previously displayed trace symbol 356*a* for the blue level and thus the light source 350*a* is already indicating that this mechanical reel 354*a* has previously displayed the trace symbol 356*a*. An appropriate message such as "YOUR THIRD FREE SPIN GAME GENERATED THESE SYMBOLS. THE THIRD FREE SPINS GAME GENERATED A THIRD TRACE SYMBOL" is provided to the player visually, such as in the message display 316, or through other suitable audio or audiovisual displays.

Figure 6E:
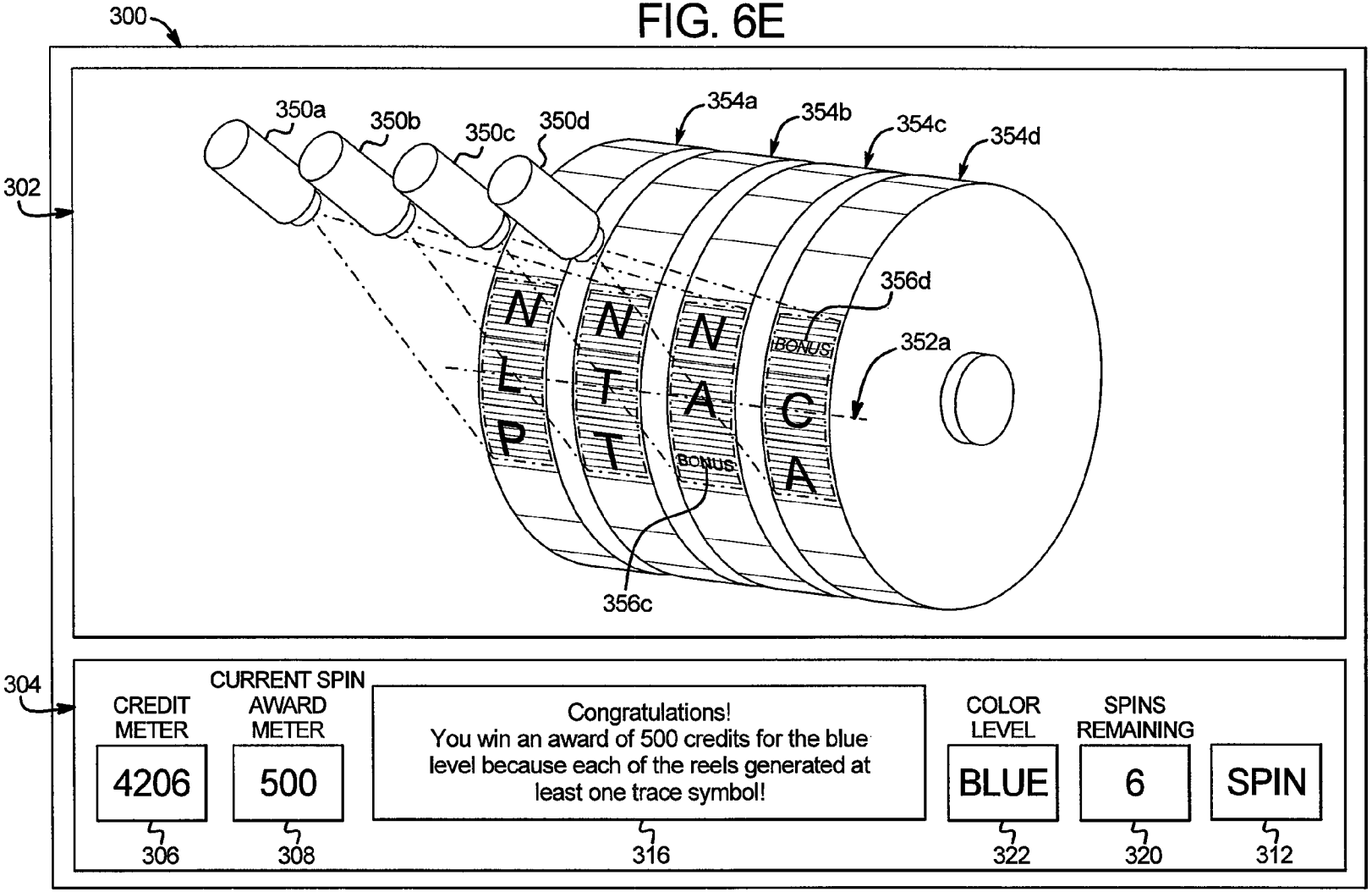

In FIG. 6E, after the player selects the spin button 312, the gaming device randomly generates and causes the mechanical reels to display a plurality of symbols for the third provided free spin game. The gaming device decreases the number of free spins remaining to provide to the player. That is, the gaming device decreases the remaining number of free spins from seven to six as indicated by the spins remaining meter 320.

In FIG. 6E, the plurality of symbols displayed includes trace symbols 356*c* and 356*d*. For the trace symbol 356*d*, the gaming device causes the light source 350*d* to illuminate a portion of the mechanical reel 354*d* to indicate to the player that the mechanical reel 354*d* displayed trace symbol 356*d*. The gaming device determines that the quantity of trace symbols indicated is equal to a designated number. More specifically, in this example embodiment, for the provided number of free spins, the gaming device determines that each of the mechanical reels have displayed at least one trace symbol. As indicated by the current spin award meter 308, the gaming device provides the player with a 500 credit award based on at least one trace symbol being generated for each of the mechanical reels. An appropriate message such as "CONGRATULATIONS! YOU WIN AN AWARD OF 500 CREDITS BECAUSE EACH OF THE REELS GENERATED AT LEAST ONE TRACE SYMBOL!" is provided to the player visually, such as in the message display 316, or through other suitable audio or audiovisual displays.

After the gaming device provides an award to the player associated with the completion of the blue level, the gaming device causes the light sources clear any indication of any previously displayed trace symbols and progress to the next level included in the secondary game. That is, the gaming device causes each of the light sources 350*a*, 350*b*, 350*c*, and 350*d* to clear the indication of the previously displayed trace symbols 356*a*, 356*b*, 356*c*, and 356*d* and progress to the yellow level.

Figure 6F:
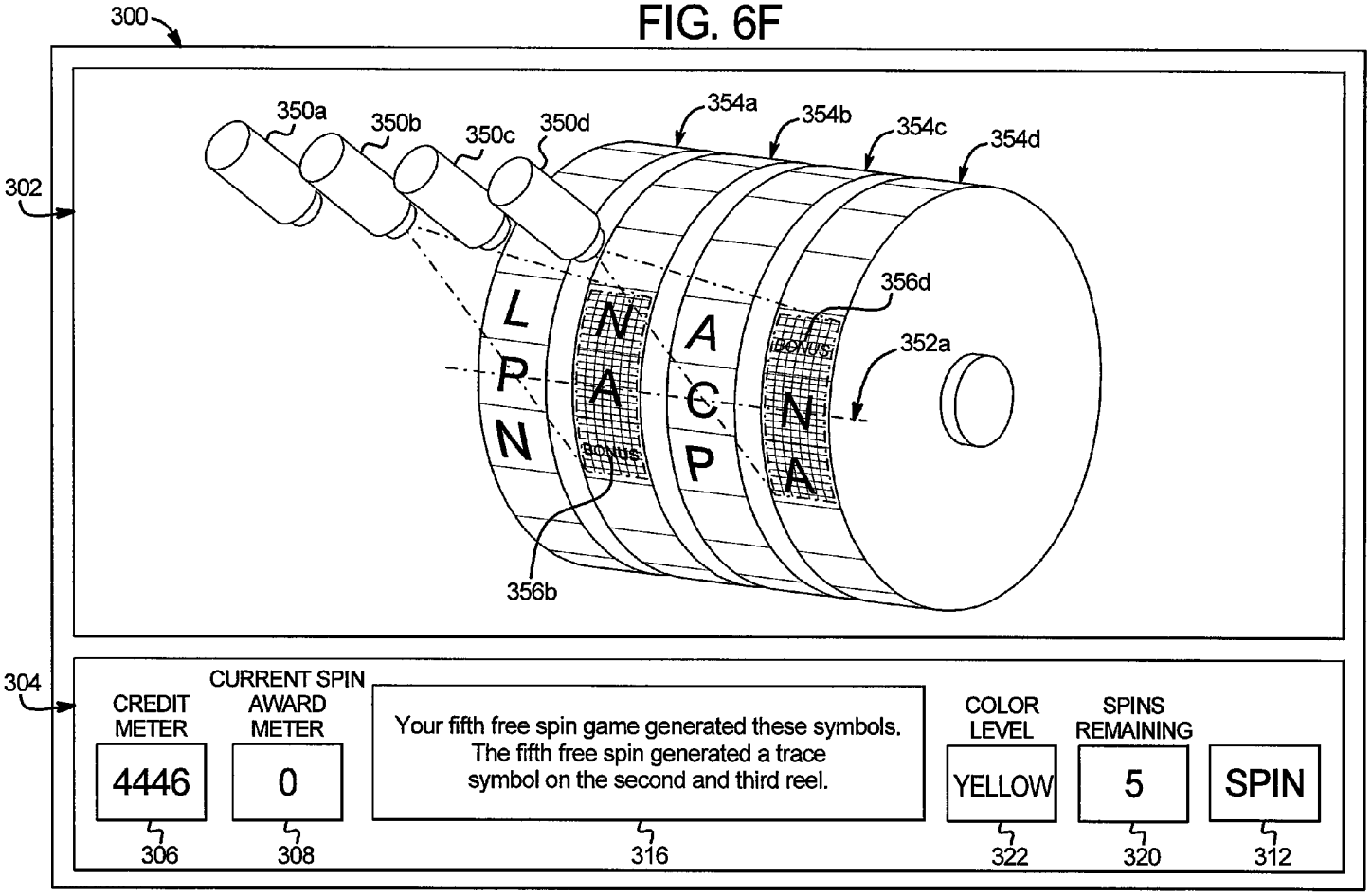

In FIG. 6F, after the player selects the spin button 312, the gaming device randomly generates and causes the mechanical reels to display a plurality of symbols for the fifth provided free spin game. For the fifth provided free spin, the color level indicator 322 displays the level associated with the play of the game. In this example, the color level indicator 322 indicates that the fifth provided free spin game is associated with the yellow level.

In FIG. 6F, the plurality of symbols displayed by the mechanical reels include trace symbols 356*b* and 356*d*. For the trace symbol 356*b*, the gaming device causes the light source 350*b* to illuminate a portion of the mechanical reel 354*b* to indicate to the player that the mechanical reel 354*b* displayed trace symbol 356*b* for one or more subsequent spins of the mechanical reels. For the trace symbol 356*d*, the gaming device causes the light source 350*d* to illuminate a portion of the mechanical reel 354*d* to indicate to the player that the mechanical reel 354*d* displayed the trace symbol 356*d* for one or more subsequent spins of the mechanical reels. In FIG. 6F, the light sources are configured to illuminate each portion of the reels using the color yellow. An appropriate message such as "YOUR FIFTH FREE SPIN GAME GENERATED THESE SYMBOLS. THE FIFTH FREE SPIN GAME GENERATED A TRACE SYMBOL ON THE SECOND REEL AND THE FOURTH REEL" is provided to the player visually, such as in the message display 316, or through other suitable audio or audiovisual displays.

Figure 6G:
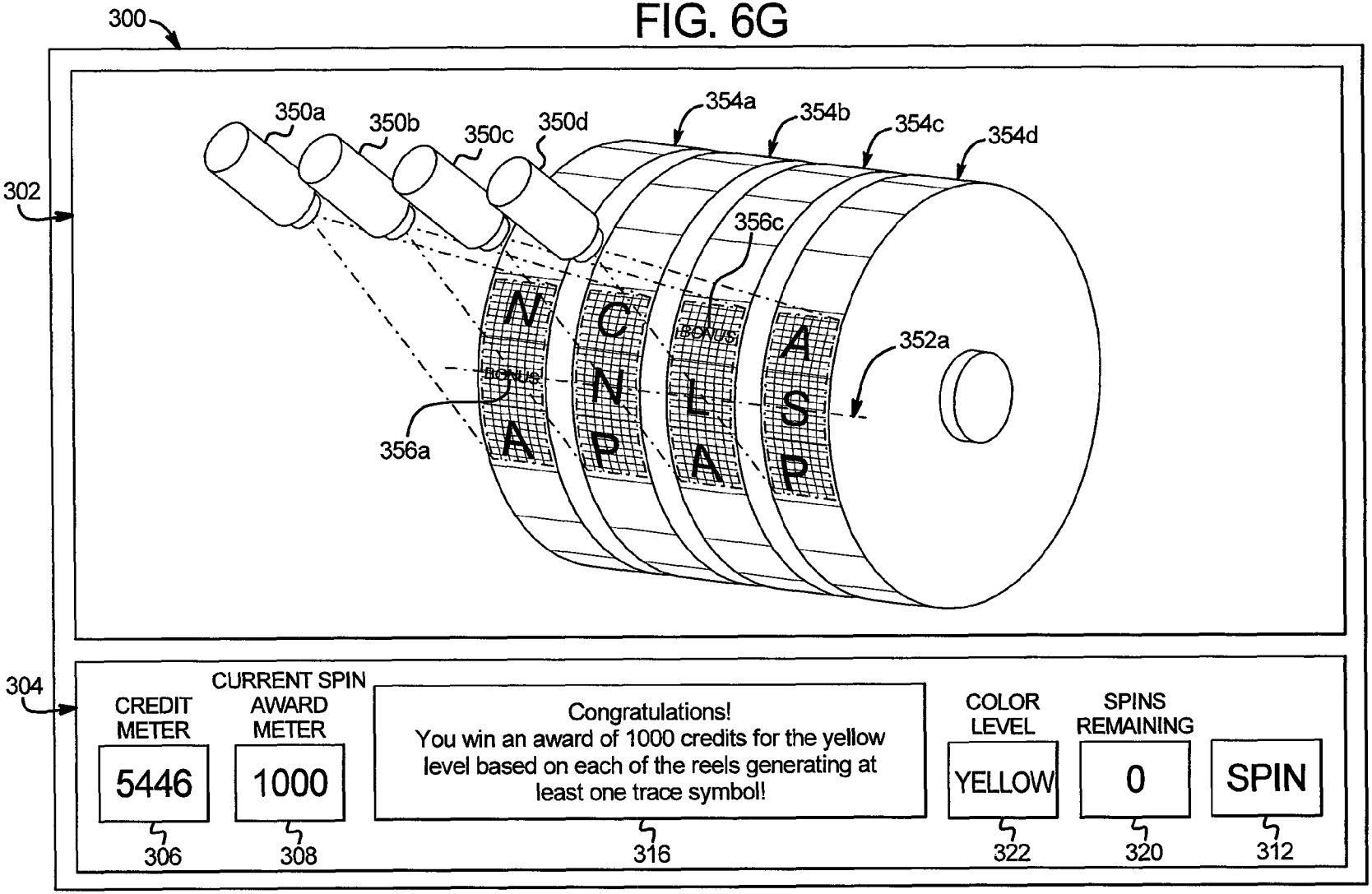

FIG. 6G illustrates a play of the secondary game wherein the player previously played the sixth provided free spin game through the ninth provided free spin game. It should be appreciated that for each of these plays of the game, the gaming device did not provide any awards to the player.

In FIG. 6G, after the player selects the spin button 312, the gaming device randomly generates and causes the mechanical reels to display a plurality of symbols for the tenth and final provided free spin game. The gaming device decreases the number of free spins remaining to provide to the player from one to zero as indicated by the spins remaining meter 320.

In FIG. 6G, the plurality of symbols displayed by the mechanical reels include trace symbols 356*a* and 356*c*. For the trace symbol 356*a*, the gaming device causes the light source 350*a* to illuminate a portion of the mechanical reel 354*a* to indicate to the player that the mechanical reel 354*a* displayed the trace symbol 356*a*. For the trace symbol 356*c*, the gaming device causes the light source 350*c* to illuminate a portion of the mechanical reel 354*c* to indicate to the player that the mechanical reel 354*c* displayed trace symbol 356*c*. In FIG. 6G, the gaming device determines that each of the mechanical reels have displayed at least one trace symbol for the yellow level. As indicated by the current spin award meter 308, the gaming device provides the player with a 1000 credit award based on at least one trace symbol being generated for each of the mechanical reels. An appropriate message such as "CONGRATULATIONS! YOU WIN AN AWARD OF 1000 CREDITS FOR THE YELLOW LEVEL BASED ON EACH OF THE REELS GENERATING AT LEAST ONE TRACE SYMBOL!" is provided to the player visually, such as in the message display 316, or through other suitable audio or audiovisual displays.

Although this example embodiment is described as being employed in a secondary game, it should be appreciated that this embodiment may be employed in a primary game.

It should also be appreciated that in one alternative embodiment, the gaming device employs certain trace symbols as wild symbols and certain different trace symbols as accumulation symbols which provide awards based on a designated amount of accumulated trace symbols. In another alternative embodiment, one or more of the trace symbol can function as both a wild symbol and as accumulation symbol.

It should be appreciated that the gaming device can illuminate portions of the mechanical reels in any suitable manner. The light source can include illumination devices such as, for example, single color light emitting diodes, Red-Green-Blue (RGB) light emitting diodes, and light bulbs for front illumination or back illumination of the reels.

In an alternative embodiment, the gaming device employs a refractive light display positioned in front of the mechanical reels which includes a substantially transparent material that includes a refractive surface. A light source directs light into one or more of the edges of the transparent material and light travels through the material and is directed outwardly from the refractive surface to illuminate predetermined portions of the mechanical reels. In one embodiment, the gaming device employs a method of using a refractive light display such as disclosed in U.S. Pat. No. 7,048,631.

It should further be appreciated that in alternative embodiments, for each of one or more of the displayed trace symbols, the gaming device causes the at least one light to illuminate different areas or portions of the mechanical reels to indicate that the mechanical reel previously displayed the displayed trace symbol. The gaming device can determine which areas of the mechanical reels to illuminate based on any suitable criteria. In different embodiments, for each trace symbol displayed on a mechanical reel the determination of which areas of the mechanical reels to illuminate predetermined, randomly determined, determined based on the player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day), determined based on an amount of coin-in accumulated in one or more pools or determined based on any other suitable method or criteria.

It should also be appreciated that the trace symbols can be activated in any suitable manner. In one embodiment, the gaming device activates one or more trace symbols upon the player placing the wager on the game. In another embodiment, the player activates a trace symbol by placing one or more side wagers. In different embodiments, the determination of whether to activate a trace symbol is predetermined, randomly determined, determined based on the player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day), determined based on an amount of coin-in accumulated in one or more pools or determined based on any other suitable method or criteria.

It should be appreciated that a designated number of a plurality symbols included on a plurality of mechanical reels which function as trace symbols can be determined in any suitable manner. In different embodiments, the determination of the designated number of the plurality symbols included on the plurality of reels which function as trace symbols is predetermined, randomly determined, determined based on the player's status (such as determined through a player tracking system), determined based on a generated symbol or symbol combination, determined based on a random determination by the central controller, determined based on a random determination at the gaming system, determined based on one or more side wagers placed, determined based on the player's primary game wager, determined based on time (such as the time of day), determined based on an amount of coin-in accumulated in one or more pools or determined based on any other suitable method or criteria.

In one embodiment, for each mechanical reel including at least one trace symbol, the gaming device determines if the symbols displayed by said mechanical reel for one or more spins of the reels includes a designated number of the trace symbols. In one example embodiment, the gaming device causes at least one of the light sources to illuminate a portion of a mechanical reel when that mechanical reel displays at least two trace symbols for one or more spins of the mechanical reels. In different embodiments, the determination of the designated number of trace needed to illuminate a mechanical reel is predetermined, randomly determined, determined based on the player's status (such as determined through a player tracking system), determined based on a generated symbol or symbol combination, determined based on a random determination by the central controller, determined based on a random determination at the gaming system, determined based on one or more side wagers placed, determined based on the player's primary game wager, determined based on time (such as the time of day), determined based on an amount of coin-in accumulated in one or more pools or determined based on any other suitable method or criteria.

In one embodiment, the gaming device enables a player to choose one or more of the symbols included on the mechanical reels to function as a trace symbol for one or more subsequent spins of the reels.

As stated above, in one embodiment, the gaming device determines a designated number of games remaining in which previously displayed trace symbols are maintained for subsequent spins of the mechanical reels. In different embodiments, the determination of the designated number of games is predetermined, randomly determined, determined based on the player's status (such as determined through a player tracking system), determined based on a generated symbol or symbol combination, determined based on a random determination by the central controller, determined based on a random determination at the gaming system, determined based on one or more side wagers placed, determined based on the player's primary game wager, determined based on time (such as the time of day), determined based on an amount of coin-in accumulated in one or more pools or determined based on any other suitable method or criteria.

In different embodiments, the awards based on the designated quantity of trace symbols being indicated and the awards associated with the predetermined winning combinations include, but are not limited to: a quantity of free activations of one or more games; an applicable multiplier for at least one, a plurality or each of the free spins; a credit amount (based on a triggering event and/or a wager placed); a quantity of picks in the game; a quantity of selections in the game; a quantity of retrigger symbols in the game; a quantity of terminators or termination symbols in the game; a quantity of anti-terminators in the game; a quantity of locking reels in the game; a quantity of locking symbol positions in the game; a quantity of expanding symbols in the game; a quantity of rounds or levels in the game; a quantity of award opportunities in the game; a quantity of progressive awards in the game; a range of available awards in the game; a quantity of active reels in the game; a quantity of offers in the game; a paytable which will be utilized in the game; a quantity of hands of playing cards in the game; any combination thereof; and any other suitable award.

It should be appreciated that the secondary game triggering event can be triggered in any suitable manner. In various alternative embodiments, the secondary game triggering event may be based on but not limited to at least one of: (i) an amount of time played on the gaming system; (ii) a random time of the day; (iii) an amount of money wagered on the gaming system; (iv) an amount of money lost at the gaming system; (v) an amount of money won at the gaming system; (vi) an amount of money wagered at games in a gaming system; (vii) an amount of money lost at the gaming systems in a gaming system; (viii) an amount of money won at the gaming systems in a gaming system; (ix) an event or outcome occurring in the primary game of one of the gaming systems; (x) an event occurring due to a shared random outcome generation; (xi) meeting one or more thresholds, such as a number of plays or a wager pool exceeding a designated amount; (xii) a random determination based on an amount wagered; (xiii) an occurrence of a predetermined event; (xiv) one or more side wagers placed; and (xv) any combination of these.

In different embodiments, the determination of the number of free spin games to provide to the player for the secondary game is based on the triggering event or otherwise predetermined, randomly determined, determined based on the player's status (such as determined through a player tracking system), determined based on a generated symbol or symbol combination, determined based on a random determination by the central controller, determined based on a random determination at the gaming system, determined based on one or more side wagers placed, determined based on the player's primary game wager, determined based on time (such as the time of day), determined based on an amount of coin-in accumulated in one or more pools or determined based on any other suitable method or criteria.

It should be appreciated that the illumination of the reels can be configured in multiple different manners as indicated above. FIGS. 7 through 12 illustrate various embodiments of such alternative configurations.

Figure 7:
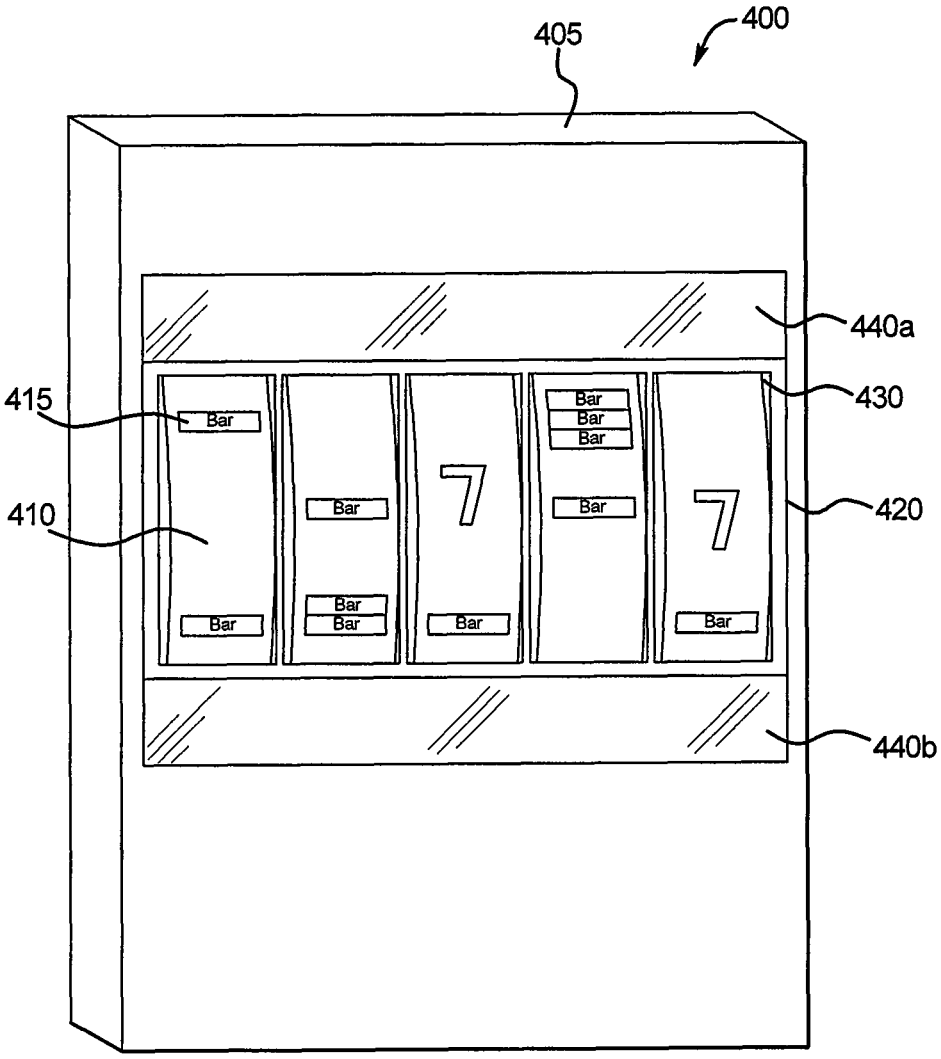
FIG. 7 is a front perspective view of another embodiment of a gaming device disclosed herein.

FIG. 7 illustrates a gaming device including a door 405 and five reels 410. Each of the reels 410 is partially visible to a player through reel glass 420. The reel glass 420 includes substantially transparent portions 430 that correspond to the portions of the reels 410 that are to be visible to the player. The reel glass 420 includes partially opaque portions 440*a* and 440*b* that display illuminated colors and/or designs. In one embodiment, the gaming device includes fluorescent backlighting for these partially opaque portions 440 to display the colors and designs printed on the reel glass 420. In one embodiment, these partially opaque portions 440*a* and 440*b* have a specially etched light reflective acrylic sheet included behind the reel glass 420 that displays the colors and designs via edge lighting. An example of the etched acrylic sheet is the light panel manufactured by the Hunatech Corporation.

Figure 8:
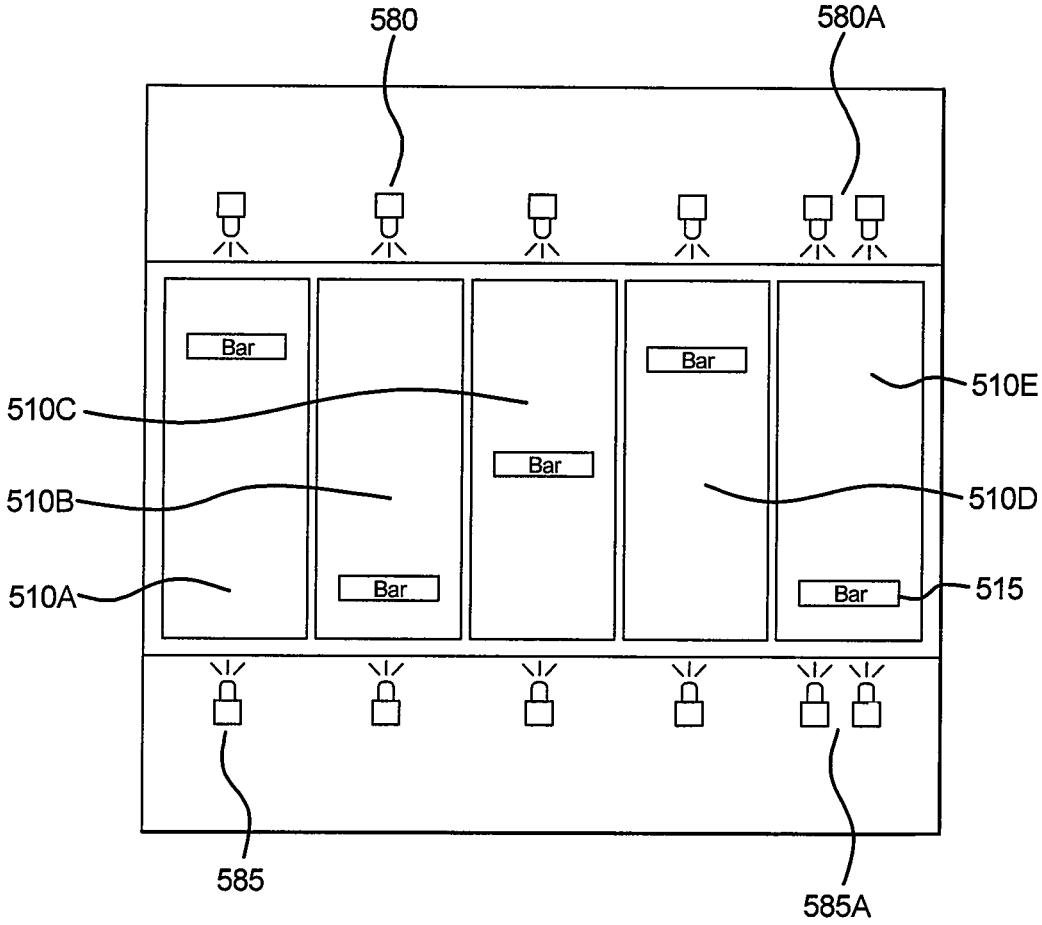
FIG. 8 is a front diagrammatic view of the gaming device of FIG. 7.

FIG. 8 illustrates the gaming device including individual reel light sources 580, 580A, 585, and 585A disposed above and below the visible portions of the reels 510A, 510B, 510C, 510D, and 510E. In an alternative embodiment, the gaming device includes the individual reel light sources 580 and does not include the individual reel light sources 585. In another embodiment, the gaming device includes the individual reel light sources 585 and does not include the individual reel light sources 580. It should be appreciated that because the reels 510 are curved toward the reel glass, the present disclosure better illuminates the reels 510 wherein the gaming device employs both the upper and lower individual reel sources 580 and 585. In one embodiment, the gaming device includes the single individual light sources 580 and/or 585 and does not include any multiple individual reel light sources 580A and/or 585A. In another embodiment, the gaming device includes multiple individual light source 580A and/or 585A for each of the reels. In one embodiment, the gaming device includes a plurality of multiple individual reel light sources 580A and/or 585A for one or more of the reels 510. It should be appreciated that this configuration allows for greater flexibility in illuminating the reels 510 to highlight wins, positive symbol hits, or bonus rounds.

In FIG. 8, reels 510A, 510B, 510C, and 510D are each illuminated above and below by single individual reel light sources 580 and 585, respectively. Reel 510E is illuminated above and below by pairs of individual reel light sources 580A and 585A, respectively. Certain symbols displayed for a play of a game cause these individual reel light sources to illuminate the reels using certain colors. In one example embodiment, wherein each of the reels 510A, 510B, 510C, and 510D display a "Bar" symbols for a play of a game, the gaming device causes the reel light sources 580 and 585 to illuminate these reels with a white color. In this example embodiment, if the reel 510E displays a "Bar" symbol for the play of the game, the gaming device causes the individual reel light sources 580A and 585A to illuminate this reel with the white color to indicate to the player a winning combination. On the other hand, if the reel 510E does not display a "Bar" symbol for the play of the game, the gaming device causes the individual reel light sources 580A and 585A to illuminate the fifth reel with a red color to indicate a losing combination.

Figure 9A:
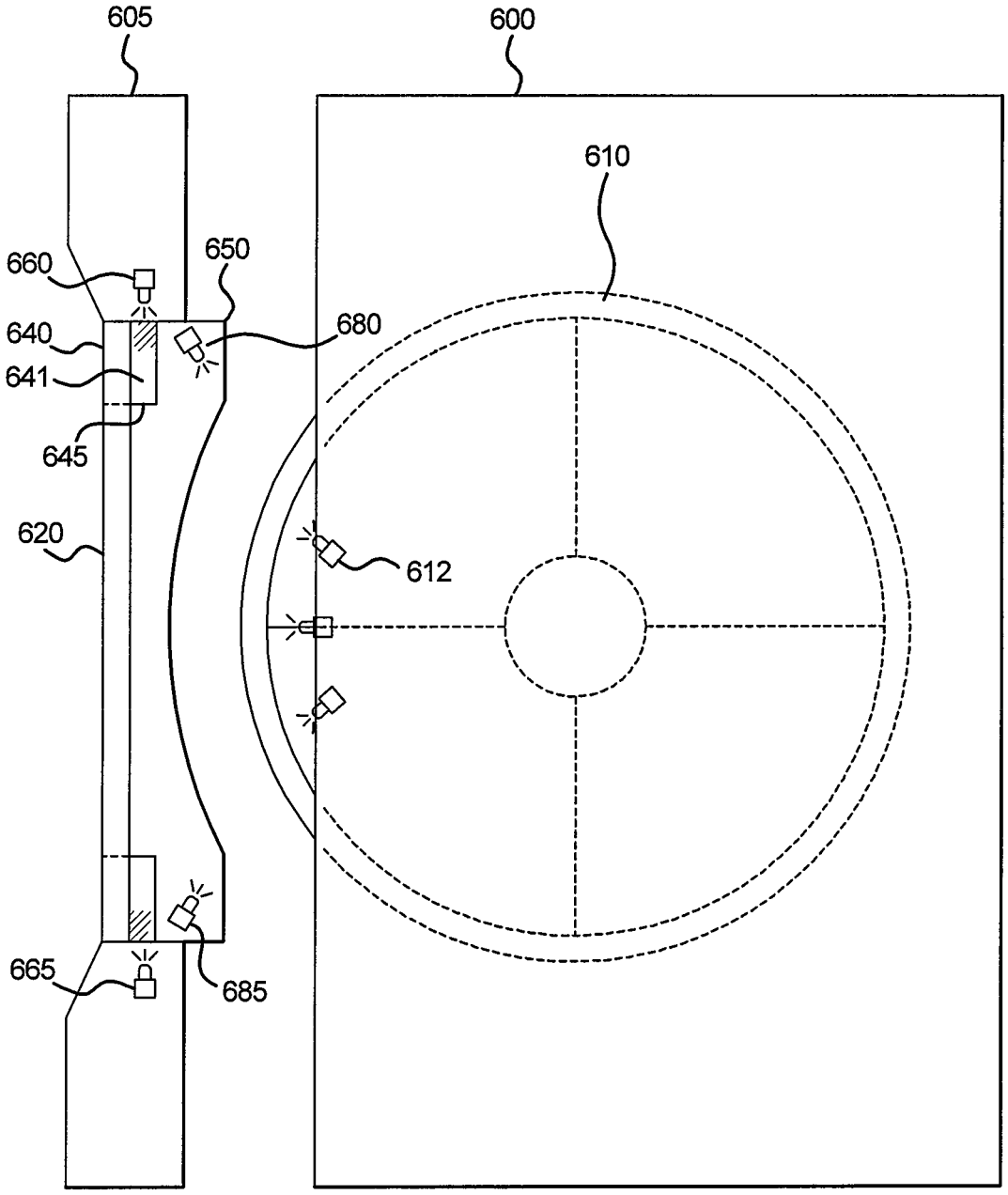
FIGS. 9A and 9B are side diagrammatic views of the gaming device of FIG. 7, illustrating a door in an open and closed position.

FIG. 9A illustrates the gaming device 600 including a plurality of reels 610 and a plurality of reel back lights 612. The plurality of reel back lights 612 illuminate a particular symbol on the reel when it lands in a predetermined symbol position. In this embodiment, for each of the reels 610, three reel back lights 612 are positioned to illuminate a symbol for each symbol position displayed to the player. In one embodiment, the gaming device employs these reel back lights 612 in conjunction with the individual reel light sources 680 and 685. Although not shown in the drawings, in one embodiment, the gaming device employs a plurality of suitable barriers so that light from adjacent individual light sources may be blocked from illuminating a particular symbol position on a reel. In one embodiment, such barriers are positioned behind the reels.

Figure 9B:
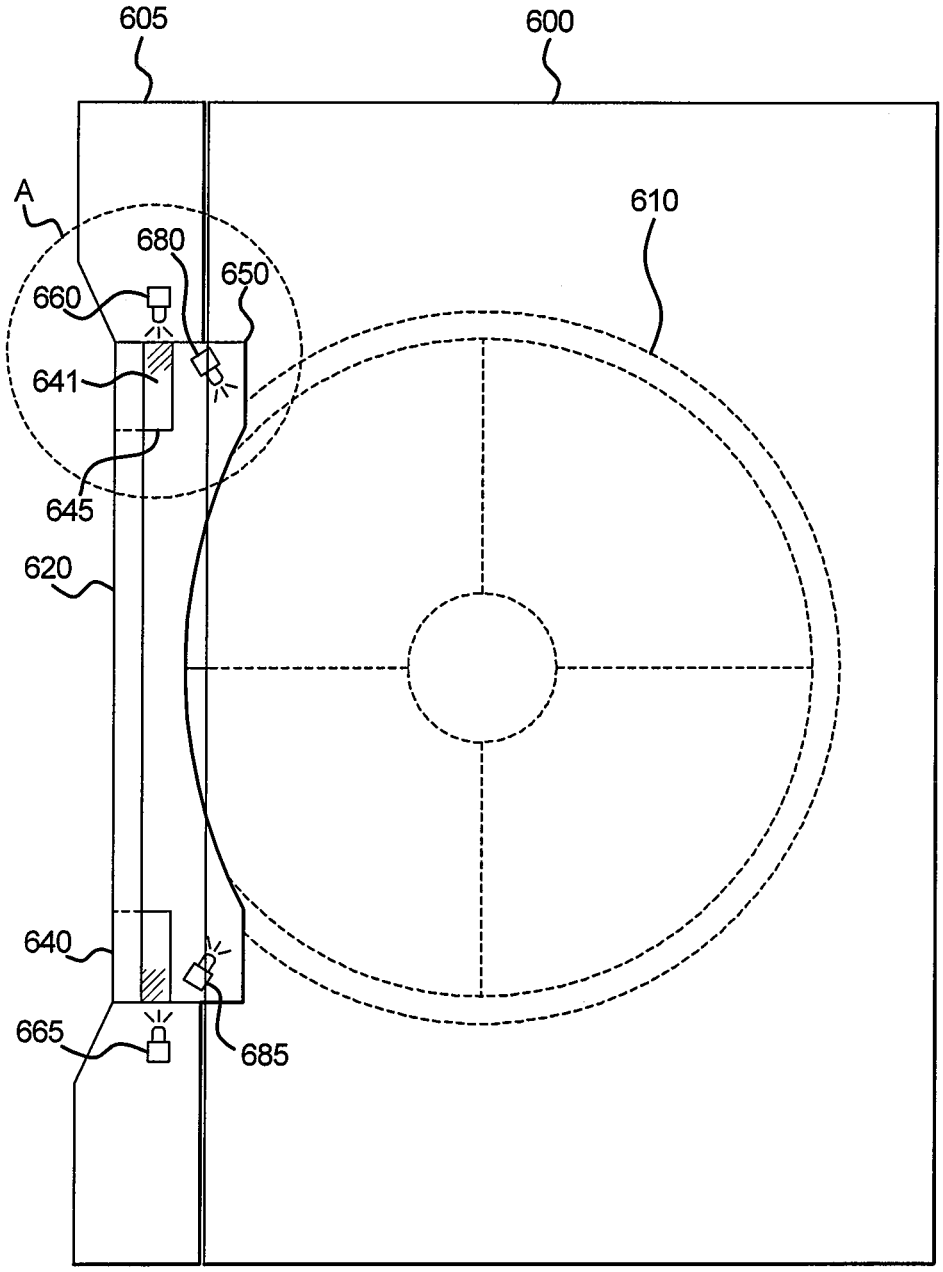

FIGS. 9A and 9B illustrate the gaming device 600 including a door 605 which includes reel glass 620 having substantially transparent portions to display portions of the reels 610 and portions that are substantially opaque as described with reference to FIG. 7. The gaming device also includes upper edge lights 660 and lower edge lights 665 which illuminate etched light panels 641. The gaming device door 605 includes upper individual reel light sources 680 and lower individual reel light sources 685. As shown in FIGS. 9A and 9B, the upper and lower individual reel light sources 680 and 685 are angled toward the reels 610 to provide better illumination of the reels 610.

The gaming device door 605 includes a molded frame 650 to visually separate the reels 610 and keep light from the individual reel light sources directed to only the proper reel 610. More specifically, the molded frame 650 is configured to restrict light from an individual reel light source 680 or 685 directed at a first reel (for example reel 610A) from partially illuminating portions of an adjacent reel (for example 610B) which is not illuminated by its corresponding individual reel light source 680. It should be appreciated that this feature provides a cleaner look and eliminates player confusion when the individual reel light sources 680 and 685 are illuminating portions of the reels 610.

The molded frame 650 is configured to be positioned between adjacent reels 610. The molded frame 650 includes openings which allow the reels 610 to remain visible though the transparent portions 630 of the reel glass. The molded frame 650 also includes openings that allow the upper and lower individual reel light sources 680 and 685 to illuminate the reels 610.

The molded frame 650 includes at least one panel slot 645 to fix the etched light panels 641 between the molded frame 650 and the reel glass 620. In an alternative embodiment, the molded frame doesn't include at least one panel slot because the gaming device does not include any etched light panels. The molded frame 650 may be constructed of one or more of a plastic, a polymer, a metal, or any other material suitable to block light.

FIG. 9B illustrates the gaming device including the door in a closed position. In FIG. 9B, where the door 605 is closed against the gaming device 600, the molded frame 650 is configured to be positioned between adjacent reels 610. This configuration prevents light from an individual reel light source 680 and 685 from partially illuminating an adjacent spinning reel 610.

Figure 9C:
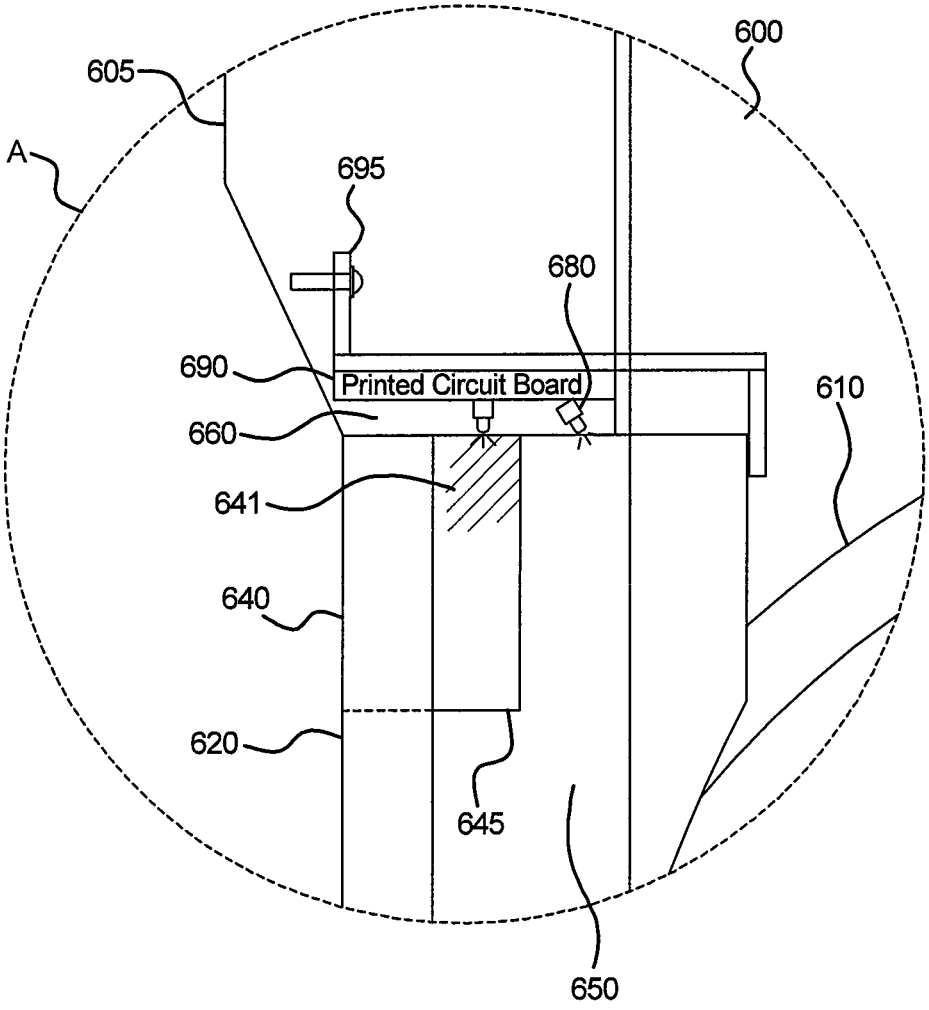
FIG. 9C is an enlarged fragmentary view a portion of the gaming device of FIG. 7, illustrating the edge lit lights and the individual reel light sources connected to a common printed circuit board.
Figure 10:
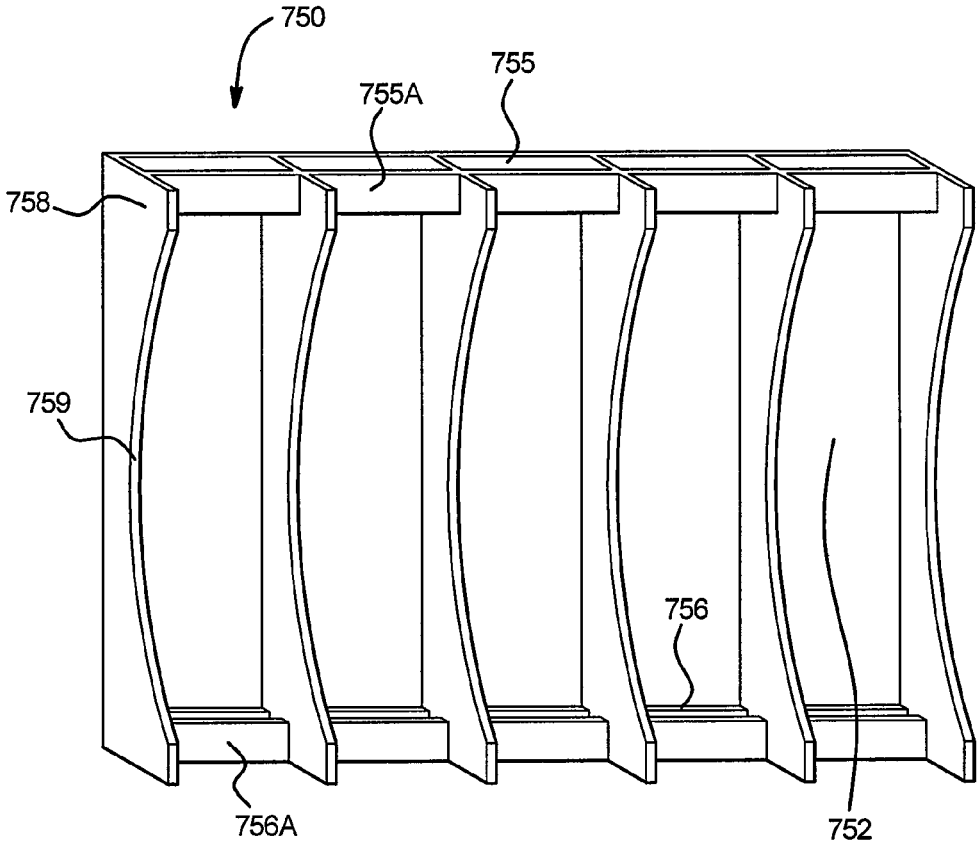
FIG. 10 is a rear perspective view of one embodiment of a molded frame of the gaming device of FIG. 7.

FIG. 9C illustrates the gaming device including edge lit lights and individual reel light sources connected to a common printed circuit board. The edge lights 660 and the individual reel light sources 680 are connected to, and directly attached to a common PCB (printed circuit board) 690. In an alternative embodiment (not shown), the individual reel light sources 680 are disposed within the molded frame 650 and electrically connected to the PCB 690 through a wire or other connection means. In one embodiment, the lower edge lights 665 and lower individual reel lights sources 685 are mounted to a separate common PCB (not shown) from the upper edge lights and upper individual reel light sources.

The PCB 690 is mounted to the door 605 through a mounting bracket 695. In one embodiment, the molded frame 650 is at least partially attached to the door 605 through the mounting bracket 695. In one embodiment, the PCB 690 is electrically connected to a gaming processor in the gaming device, where the gaming processor controls the illumination timing, color, and intensity of the individual reel light sources 680 and 685.

Figure 11:
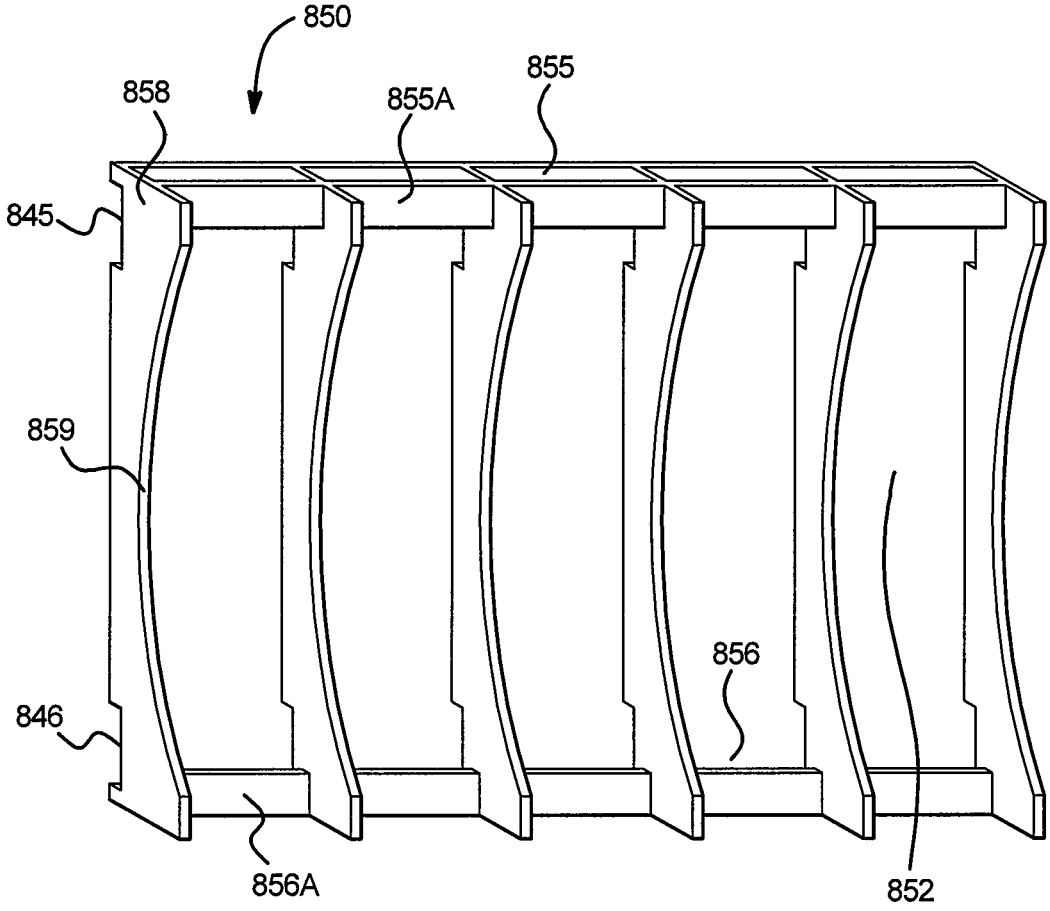
FIG. 11 is a rear perspective view of an alternative embodiment of a molded frame which includes panel slots.

FIG. 11 illustrates the molded frame 750 including edge portions 758 and middle curved portions 759 to position the molded frame 750 between individual reels so that light from adjacent individual reel light sources may be blocked from illuminating a particular spinning reel. The molded frame 750 includes a plurality of reel openings 752 positioned between the curved portions 759 of the molded frame to allow the reels to be visible to the player. More specifically, the gaming device includes five reel openings 752 to correspond to five reels on the gaming device. It should be appreciated that in different embodiments, the number of reel openings may be increased or decreased depending upon the number of reels of a gaming device.

The molded frame 750 includes a plurality of upper light openings 755 and a plurality of lower light openings 756 to respectively allow the upper and lower individual reel light sources to illuminate corresponding reels. Although not shown in FIG. 11, the inner barriers 755A and 756A of the upper and lower light openings 755 and 756 may be angled toward the reels to further help the individual reel light sources to illuminate the full visible portion of the reels. In one alternative embodiment, the gaming device does not include the inner barriers 755A and 756A.

Figure 12:
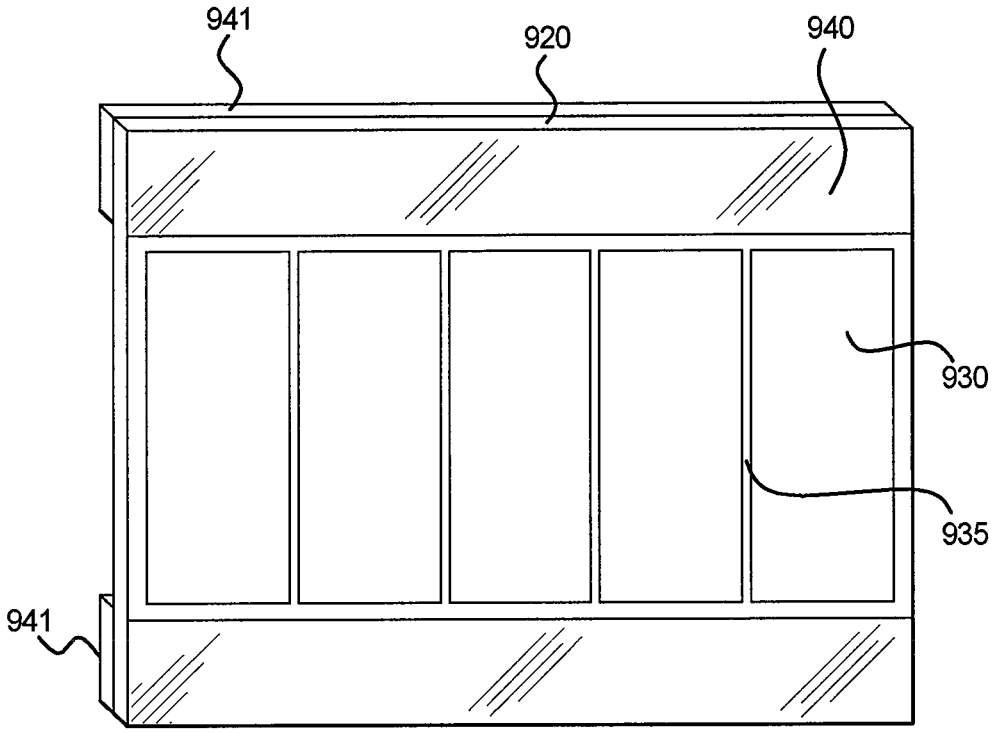
FIG. 12 is a front perspective view of the reel glass of the gaming device of FIG. 7.

FIG. 12 illustrates the molded frame 850 including an upper panel slot 845 in the upper portion of the molded frame 850 and a lower panel slot 846 in the lower portion of the molded frame 850. The upper panel slot 845 and lower panel slot 846 are configured to coordinate with the etched light panels 641 shown in FIGS. 9A to 9C.

FIG. 13 illustrates the reel glass 920 of a gaming device including substantially opaque header/footer portions 940, substantially transparent reel window portions 930, and substantially opaque reel divider portions 935. These portions may be backlit by one or more light sources and/or edge lit by one or more light sources.

It should be appreciated that although the present disclosure can be implemented using video reels, the present disclosure provides a better gaming experience for the player when implemented using mechanical reels.

Thus, it should be appreciated that in one embodiment, the gaming device causes at least one processor to operate with a plurality of mechanical reels, at least one light source and at least one input device to, for each of a plurality of spins of the mechanical reels, randomly generate and cause the plurality of mechanical reels to display a plurality of the symbols, wherein for each mechanical reel the gaming device determines if the symbols displayed by the mechanical reel include on of the trace symbols. For each mechanical reel that displays one of the trace symbols, the gaming device causes the at least one light source to illuminate at least one portion of that mechanical reel for one or more subsequent spins of the mechanical reels to indicate to a player that the mechanical reel previously displayed the trace symbol. In this embodiment, the gaming device provides an award based in a designated quantity of trace symbols being indicated wherein the designated quantity is at least two.

It should be appreciated that in one embodiment, the gaming device causes at least one processor to operate with a plurality of mechanical reels, at least one light source and at least one input device to, for each of a mechanical reel that displays one of the trace symbols, cause the at least one light source to illuminate at least one portion of that mechanical reel which displays the trace symbol for one or more subsequent spins of the mechanical reels to indicate a wild symbol position to a player. In this embodiment, the gaming device determines whether any of the symbols displayed in combination with any of the wild positions indicated include a winning combination. The gaming device provides any award associated with the determined winning combination.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming device comprising:

a cabinet;

a plurality of mechanical reels supported by the cabinet, each of the mechanical reels including a plurality of symbol positions, each of the symbol positions displaying one of a plurality of symbols, said plurality of symbols for at least two of the plurality of mechanical reels including one or more trace symbols;

at least one light source supported by the cabinet;

at least one input device supported by the cabinet;

at least one processor; and at least one memory device which stores a plurality of instructions, which when executed by the at least one processor, cause the at least one processor to operate with the plurality of mechanical reels, the at least one light source, and the at least one input device to:

(a) for each of a plurality of spins of the plurality of mechanical reels:

(i) randomly generate and cause the plurality of mechanical reels to display to a player the symbols displayed at a plurality of the symbol positions on said mechanical reels, said symbols being displayed at a plurality of symbol display positions associated with said mechanical reels;

(ii) for each mechanical reel including one or more trace symbols:

(A) determine if the symbols of said mechanical reel displayed to the player include a designated number of the trace symbols, said designated number being at least one; and (B) if the symbols of said mechanical reel displayed to the player include the designated number of the trace symbols, cause the at least one light source to illuminate at least one of the symbol display positions associated with said mechanical reel for at least one subsequent spin of the mechanical reels, the at least one illuminated symbol display position corresponding to the symbol position at which at least one of the designated number of the trace symbols is displayed; and (b) if a designated quantity of at least two of the mechanical reels are associated with illuminated symbol display positions, provide an award based on said designated quantity of the mechanical reels being associated with illuminated symbol display positions regardless of the symbols of said mechanical reels displayed to the player.

2. The gaming device of claim 1, wherein the at least one light source includes a plurality of lights.

3. The gaming device of claim 1, wherein the at least one light source includes at least one Red-Green-Blue light emitting diode configured to illuminate the at least one symbol display position with different colors.

4. The gaming device of claim 1, wherein the plurality of instructions, when executed by the at least one processor, cause the at least one processor to, for each mechanical reel including one or more trace symbols, if the symbols of said mechanical reel displayed to the player include the designated number of the trace symbols, cause the at least one light source to illuminate at least one of the symbol display positions associated with said mechanical reel by illuminating at least one of, but not all of, the symbol display positions associated with said mechanical reel.

5. The gaming device of claim 1, wherein the plurality of instructions, when executed by the at least one processor, cause the at least one processor to, for each mechanical reel including one or more trace symbols, if the symbols of said mechanical reel displayed to the player include the designated number of the trace symbols, cause the at least one light source to illuminate at least one of the symbol display positions associated with said mechanical reel by illuminating all of the symbol display positions associated with said mechanical reel.

6. The gaming device of claim 1, wherein the plurality of instructions, when executed by the at least one processor, cause the at least one processor to operate with a display device to, for each illuminated symbol display position, display a number of subsequent spins of the plurality of mechanical reels for which said at least one light source will illuminate said symbol display position.

7. The gaming device of claim 1, wherein the plurality of instructions, when executed by the at least one processor, cause the at least one processor to operate with the plurality of mechanical reels, the at least one light source, and the at least one input device to activate at least one trace symbol included on the mechanical reels.

8. The gaming device of claim 7, wherein the plurality of instructions, when executed by the at least one processor, cause the at least one processor to operate with the at least one input device to activate the at least one trace symbol based on a minimum wager made by the player.

9. The gaming device of claim 7, wherein the at least one trace symbol is activated for at least one subsequent spin of the mechanical reels.

10. The gaming device of claim 1, wherein at least one of the plurality of mechanical reels includes a plurality of trace symbols.

11. The gaming device of claim 1, wherein the award provided based on the designated quantity of the mechanical reels being associated with illuminated symbol display positions includes a secondary game.

12. A gaming device comprising:

a cabinet;

a plurality of mechanical reels supported by the cabinet, each of the mechanical reels including a plurality of symbol positions, each of the symbol positions displaying one of a plurality of symbols, said plurality of symbols for at least two of the plurality of mechanical reels including one or more trace symbols;

at least one light source supported by the cabinet;

at least one input device supported by the cabinet;

at least one processor; and at least one memory device which stores a plurality of instructions, which when executed by the at least one processor, cause the at least one processor to operate with the plurality of mechanical reels, the at least one light source, and the at least one input device to:

(a) for each of a plurality of spins of the plurality of mechanical reels:

(i) randomly generate and cause the plurality of mechanical reels to display to a player the symbols displayed at a plurality of the symbol positions on said mechanical reels, said symbols being displayed at a plurality of symbol display positions associated with said mechanical reels;

(ii) for each mechanical reel including one or more trace symbols:

(A) determine if the symbols of said mechanical reel displayed to the player include a designated number of the trace symbols;

(B) if the symbols of said mechanical reel displayed to the player include the designated number of the trace symbols, cause the at least one light source to illuminate at least one of the symbol display positions associated with said mechanical reel for at least one subsequent spin of the mechanical reels to indicate a wild symbol display position to the player, the at least one illuminated symbol display position corresponding to the symbol position at which at least one of the designated number of the trace symbols is displayed;

(iv) determine whether any of the symbols of the mechanical reels displayed to the player combine with any illuminated wild symbol display positions to form a winning combination;

(v) provide any award associated with any formed winning combinations; and (vi) if a designated quantity of at least two of the mechanical reels are associated with illuminated wild symbol display positions, provide an additional award based on said designated quantity of the mechanical reels being associated with illuminated symbol display positions regardless of the symbols of said mechanical reels displayed to the player.

13. The gaming device of claim 12, wherein the at least one light source includes a plurality of lights.

14. The gaming device of claim 12, wherein the at least one light source includes at least one Red-Green-Blue light emitting diode configured to illuminate the at least one symbol display position with different colors.

15. The gaming device of claim 12, wherein the plurality of instructions, when executed by the at least one processor, cause the at least one processor to, for each mechanical reel including one or more trace symbols, if the symbols of said mechanical reel displayed to the player include the designated number of the trace symbols, cause the at least one light source to illuminate at least one of the symbol display positions associated with said mechanical reel by illuminating at least one of, but not all of, the symbol display positions associated with said mechanical reel.

16. The gaming device of claim 12, wherein the plurality of instructions, when executed by the at least one processor, cause the at least one processor to, for each mechanical reel including one or more trace symbols, if the symbols of said mechanical reel displayed to the player include the designated number of the trace symbols, cause the at least one light source to illuminate at least one of the symbol display positions associated with said mechanical reel by illuminating all of the symbol display positions associated with said mechanical reel.

17. The gaming device of claim 12, wherein the plurality of instructions, when executed by the at least one processor, cause the at least one processor to operate with a display device to, for each illuminated symbol display position, display a number of subsequent spins of the plurality of mechanical reels for which said at least one light source will illuminate said symbol display position.

18. The gaming device of claim 12, wherein the plurality of instructions, when executed by the at least one processor, cause the at least one processor to operate with the plurality of mechanical reels, the at least one light source, and the at least one input device to activate at least one trace symbol for each of a plurality of the mechanical reels.

19. The gaming device of claim 18, wherein the plurality of instructions, when executed by the at least one processor, cause the at least one processor to operate with the at least one input device to activate the at least one trace symbol based on a minimum wager made by the player.

20. The gaming device of claim 18, wherein the at least one trace symbol is activated for at least one subsequent spin of the mechanical reels.

21. The gaming device of claim 12, wherein at least one of the plurality of mechanical reels includes a plurality of trace symbols.

22. The gaming device of claim 12, wherein the award provided associated with any formed winning combinations includes a credit award.

* * * * *

UNITED STATES PATENT AND TRADEMARK OFFICE

CERTIFICATE OF CORRECTION

PATENT NO. : 8,814,654 B2
APPLICATION NO. : 12/271018
DATED : August 26, 2014
INVENTOR(S) : Benjamin C. Hoffman et al.

It is certified that error appears in the above-identified patent and that said Letters Patent is hereby corrected as shown below:

IN THE CLAIMS

In Claim 1, Column 35, Line 19, after ";" insert --and--.
In Claim 9, Column 36, Line 21, between "for" and "at" insert --the--.
In Claim 12, Column 36, Line 58, after ";" insert --and--.
In Claim 12, Column 37, Line 3, replace "(iv)" with --(iii)--.
In Claim 12, Column 37, Line 7, replace "(v)" with --(iv)--.
In Claim 12, Column 37, Line 9, replace "(vi)" with --(v)--.
In Claim 20, Column 38, Line 26, between "for" and "at" insert --the--.

Signed and Sealed this
Eleventh Day of August, 2015

Michelle K. Lee

Michelle K. Lee
*Director of the United States Patent and Trademark Office*